US012156551B2

(12) United States Patent
Liu

(10) Patent No.: US 12,156,551 B2
(45) Date of Patent: Dec. 3, 2024

(54) ITEM OF CLOTHING AND MANUFACTURING METHOD THEREOF

(71) Applicant: Regina Miracle International (Group) Limited, Hong Kong (CN)

(72) Inventor: Zhenqiang Liu, Hong Kong (CN)

(73) Assignee: Regina Miracle International (Group) Limited, Hong Kong (CN)

( * ) Notice: Subject to any disclaimer, the term of this patent is extended or adjusted under 35 U.S.C. 154(b) by 356 days.

(21) Appl. No.: 17/614,831

(22) PCT Filed: May 29, 2020

(86) PCT No.: PCT/CN2020/093445

§ 371 (c)(1),
(2) Date: Jul. 22, 2022

(87) PCT Pub. No.: WO2020/239101

PCT Pub. Date: Dec. 3, 2020

(65) Prior Publication Data

US 2022/0361596 A1 Nov. 17, 2022

(30) Foreign Application Priority Data

May 31, 2019 (WO) ..... PCT/CN2019/089610
Jan. 21, 2020 (CN) ..... 202010071731.0

(51) Int. Cl.
*A41C 3/10* (2006.01)
*A41C 3/14* (2006.01)
*A41C 5/00* (2006.01)

(52) U.S. Cl.
CPC ..... *A41C 3/10* (2013.01); *A41C 3/142* (2013.01); *A41C 5/005* (2013.01)

(58) Field of Classification Search
CPC ..... A41C 3/10; A41C 3/142
(Continued)

(56) References Cited

U.S. PATENT DOCUMENTS 2,915,067 A * 12/1959 Bracht ..... A41C 3/142 450/109
3,163,167 A * 12/1964 Chisholm ..... A41C 3/142 D2/706

(Continued)

FOREIGN PATENT DOCUMENTS

CN 2323608 Y 6/1999
CN 101536814 A 9/2009

(Continued)

OTHER PUBLICATIONS

Authorized Officer: Xie, Jianjun, International Search Report and Written Opinion issued in PCT application No. PCT/CN2019/089610, Feb. 21, 2020, 9 pp.

(Continued)

*Primary Examiner* — Jocelyn Bravo
(74) *Attorney, Agent, or Firm* — Kaplan Breyer Schwarz, LLP

(57) ABSTRACT

An article of clothing and a method of manufacturing thereof are disclosed. The article of clothing comprises a pair of brassiere cups and a pair of frames. Each frame further comprises a bottom member attachable to an underwire of a respective one of the brassiere cups; at least one first projection which originates from the lower member and extends beyond the upper member; at least one second projection which extends from the lower member and extends beyond the upper member. The at least one second projection is closer than the at least one first projection to an underarm region of the respective one of the brassiere cups.

21 Claims, 21 Drawing Sheets

(58) Field of Classification Search
USPC ..... 450/44, 53
See application file for complete search history.

(56) References Cited

U.S. PATENT DOCUMENTS

| | | | | | |
|---|---|---|---|---|---|
| 3,196,460 | A * | 7/1965 | Haistead | A41C 3/142 | 2/262 |
| 3,351,954 | A * | 11/1967 | Chalfin | A41C 1/14 | 450/41 |
| 3,378,012 | A * | 4/1968 | Schwartz | A41C 3/0007 | 450/60 |
| 3,605,753 | A | 9/1971 | Schwartz | | |
| 3,702,614 | A | 11/1972 | Miller | | |
| 4,632,118 | A * | 12/1986 | Garutso | A41C 3/10 | 450/53 |
| 5,141,470 | A | 8/1992 | Morgan et al. | | |
| 6,966,815 | B2 * | 11/2005 | Weinerth | A41C 3/10 | 450/39 |
| 7,234,994 | B2 * | 6/2007 | Fildan | A41C 3/128 | 450/47 |
| 7,309,276 | B2 * | 12/2007 | Legaspi | A41C 3/10 | 450/41 |
| 10,448,679 | B1 * | 10/2019 | Roddis | A41C 3/12 | |
| 10,772,362 | B2 * | 9/2020 | Corley | A41C 3/142 | |
| 2002/0098775 | A1 * | 7/2002 | Avellanet | A41C 3/124 | 450/41 |
| 2016/0037831 | A1 * | 2/2016 | Hernandez | A41C 3/065 | 450/53 |
| 2016/0227846 | A1 * | 8/2016 | Funk-Danielson | A41C 3/128 | |
| 2018/0168243 | A1 | 6/2018 | Chan | | |
| 2018/0295893 | A1 * | 10/2018 | Corley | A41C 3/146 | |

FOREIGN PATENT DOCUMENTS

| | | | |
|---|---|---|---|
| CN | 101779832 | A | 7/2010 |
| CN | 101808542 | A | 8/2010 |
| CN | 202077593 | U | 12/2011 |
| CN | 103124502 | A | 5/2013 |
| CN | 203776175 | U | 8/2014 |
| CN | 203986177 | U | 12/2014 |
| CN | 205233495 | U | 5/2016 |
| CN | 106072813 | A | 11/2016 |
| CN | 206380724 | U | 8/2017 |
| CN | 108201181 | A | 6/2018 |
| CN | 208676386 | U | 4/2019 |
| EP | 3087854 | A1 | 11/2016 |
| JP | 2824055 | B | 11/1998 |
| JP | 31-059320 | U | 5/2010 |

OTHER PUBLICATIONS

Office Action issued in counterpart Chinese patent application No. 202010071731.0, Mar. 16, 2021, 20 pp. w/translation.
International Search Report issued in counterpart PCT application No. PCT/CN2020/093445, Aug. 21, 2020, 2 pp.
Office Action issued in corresponding Chinese Patent Application No. 202080039202.0 on Feb. 2, 2024 and English Translation thereof.
Office Action issued in corresponding Chinese Patent Application No. 202080039202.0 on Jun. 19, 2023 and English Translation thereof.
Official Notice of Rejection issued in corresponding Japanese Patent Application No. 2021-571366 on Feb. 20, 2024 and English Translation thereof.
Reject Decision issued on Apr. 9, 2024 in corresponding Chinese Patent Application No. 202080039202.0 and English Translation thereof.

* cited by examiner

ITEM OF CLOTHING AND MANUFACTURING METHOD THEREOF

FIELD OF THE PRESENT DISCLOSURE

The present disclosure relates generally to articles of clothing, and in particular, to an article of clothing having a frame to support and maintain the shape of at least a portion of the article of clothing.

BACKGROUND

The undergarment known as the bra has been commonly worn by women throughout the world. Bras are known to provide breast support and comfort on an everyday basis. They are also used for their shaping effects and more recently, as fashion items. Moreover, women taking part in athletic activities have needed suitable athletic bras to protect delicate breast tissue from damage and stretching due to inadequate support, excessive motion and bounce. Additionally, it is also preferred to prevent the breasts from impeding or interfering with certain movements. Further, it is important to provide comfort to the wearer while doing all activities.

While many types of bras are available in the market which minimize breast movement, they do not provide individualized support for each breast or to accommodate a particular wearer. In addition, many types of bras do not provide individualized support to accommodate different activities. For example, a sports bra that is designed to be worn during sport activities may not be suitable to be worn during normal activities.

Accordingly, there is a need of article of clothing with a frame which support and maintain the shape of the article of clothing for all types of activities in an efficient manner.

SUMMARY

In one aspect, an article of clothing is disclosed. The article of clothing comprises a pair of brassiere cups and a pair of frames. Each frame comprises a bottom member that is located at a lower portion of a respective one of the brassiere cups. The bottom member comprises a upper member and a lower member. Each frame further comprises at least one first projection which originates from the lower member and extends beyond the upper member. Each frame further comprises at least one second projection which originates from the lower member and extends beyond the upper member. The at least one second projection is closer than the at least one first projection to an underarm region of the respective one of the brassiere cups. In one aspect, an article of clothing is disclosed. The article of clothing includes a pair of brassiere cups, and a pair of frames. Each frame includes: a bottom member positioned in a lower portion of a respective one of the pair of brassiere cups, wherein the bottom member includes an upper member and a lower member; and at least one first projection originating from the lower member and extending beyond the upper member; and at least one second projection originating from the lower member and extending beyond the upper member. The at least one second extension is closer to an underarm region of the respective one of the pair of brassiere cups than the at least one first extension.

In one or more embodiments, the at least one second projection is longer in length than the at least one first projection.

In one or more embodiments, the upper member and the lower member are connected at both ends and enclose a hollow crescent shape.

In one or more embodiments, the at least one first projection is connected to each of the upper member and the lower member, and one end of the at least one first extension is connected to the lower member, and the other end of the at least one first projection extends beyond the upper member.

In one or more embodiments, the at least one second projection is connected to each of the upper member and the lower member, and one end of the at least one second projection is connected to the lower member and the other end of the at least one second projection extends towards an apex of the respective one of the brassiere cups.

In one or more embodiments, the at least one first projection comprises a first projection member and a second projection member, and one end of each of the first projection member and the second projection member is connected to the lower member while the other end of each of the first projection member and the second projection member extends beyond the upper member.

In one or more embodiments, the first projection member and the second projection member are spaced apart from each other.

In one or more embodiments, the other ends of the first projection member and the second projection member are connected.

In one or more embodiments, the at least one second projection comprises a first projection member and a second projection member, and one end of each of the first projection member and the second projection member is connected to the lower member and the other ends of the first projection member and the second projection member are connected.

In one or more embodiments, the other ends of the first projection member and the second projection member are connected to form a rounded corner.

In one or more embodiments, the frame comprises one or more of Polypropylene (PP), Polyamide (PA), Thermoplastic Polyurethane (TPU), thermoplastic rubber (TPR), Polyoxymethylene (POM), and thermoplastic elastomers (TPE) material.

In one or more embodiments, an inner surface of the lower member that is closer to a wearer's body and an outer surface opposite the inner surface are planar or convex.

In one or more embodiments, each frame further comprises a middle member positioned above the upper member at a position where a bra pad of a corresponding one of the pair of brassiere cups is positioned, so as to support the bra pad.

In one or more embodiments, the middle member is wave-shaped.

In one or more embodiments, the middle member includes a plurality of continuous arcs.

In one or more embodiments, the structure consisting of the upper member, the first projection, the second projection and the middle member of the frame has a concave inner surface and a convex outer surface, and has a 3D shape that conforms to the shape of a corresponding one of the pair of brassiere cups.

In one or more embodiments, an outer surface of the first and second projections and an outer surface of the lower member form an angle between 90 degrees and 180 degrees In one or more embodiments, the frame further comprises a core member arranged inside the lower member in a manner of being encased by the lower member.

In one or more embodiments, the bottom member, the at least one first projection, the at least one second projection, and the middle member have a material hardness that is less than a material hardness of the core member.

In one or more embodiments, a cross-section of the core member is L-shaped.

In one or more embodiments, an upper arc width of the core member is greater than or equal to a lower arc width.

In one or more embodiments, the frame further comprises an encasing member enclosing the bottom member, the at least one first projection, the at least one second projection, and the middle member.

In one or more embodiments, the encasing member has a material hardness that is less than the material hardness of the bottom member, the at least one first projection, the at least one second projection, and the middle member.

In one or more embodiments, compared with an end of the at least one first projection extending beyond the upper member, an end of the at least one second projection extending beyond the upper member extends to an apex of a respective one of the pair of brassiere cups In one or more embodiments, the upper and lower members are connected at one end and to the at least one second projection at the other end.

In another aspect, a method of manufacturing an article of clothing is disclosed. The method comprises molding a frame. The step of molding the frame includes injecting a first material into the mold to form a first structure comprising: a bottom member positioned below a respective one of a pair of brassiere cups, wherein the bottom member includes an upper member and a lower member; at least one first projection originating from the lower member and extending beyond the upper member; and at least one second projection originating from the lower member and extending beyond the upper member, wherein the at least one second projection is closer than the at least one first projection to an underarm region of a respective one of the pair of brassiere cups. The method also includes providing a molded first and second layers including a pair of brassiere cups to sandwich the frame between the first and second layers.

In one or more embodiments, the step of molding the frame further comprises injecting a second material into a mold to mold a core member, wherein the core member is encased within the lower member of the bottom member.

In one or more embodiments, the step of molding the frame further comprises: injecting a third material into the mold to mold an encasing member enclosing the bottom member, the at least one first projection, and the at least one second projection.

In one or more embodiments, the first structure formed by injecting the first material into the mold further comprises a middle member positioned above the upper member at a position where a bra pad of a respective one of the pair of brassiere cups is located so as to support the bra pad.

In one or more embodiments, the hardness of the first material is less than the hardness of the second material.

In one or more embodiments, the hardness of the first material is greater than the hardness of the third material.

In one or more embodiments, an inner surface of the lower member that is closer to a wearer's body and an outer surface opposite the inner surface are planar or convex In one or more embodiments, the middle member is wave-shaped.

In one or more embodiments, the middle member includes a plurality of continuous arcs.

In one or more embodiments, a second structure consisting of the upper member, the first projection, the second projection and the middle member of the frame has a concave inner surface and a convex outer surface, and has a 3D shape that conforms to the shape of a corresponding one of the pair of brassiere cups.

In one or more embodiments, an outer surface of the first and second projections and an outer surface of the lower member form an angle between 90 degrees and 180 degrees.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

For a more complete understanding of example embodiments of the present disclosure, reference is now made to the following descriptions taken in connection with the accompanying drawings in which.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced item. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Figure 1:
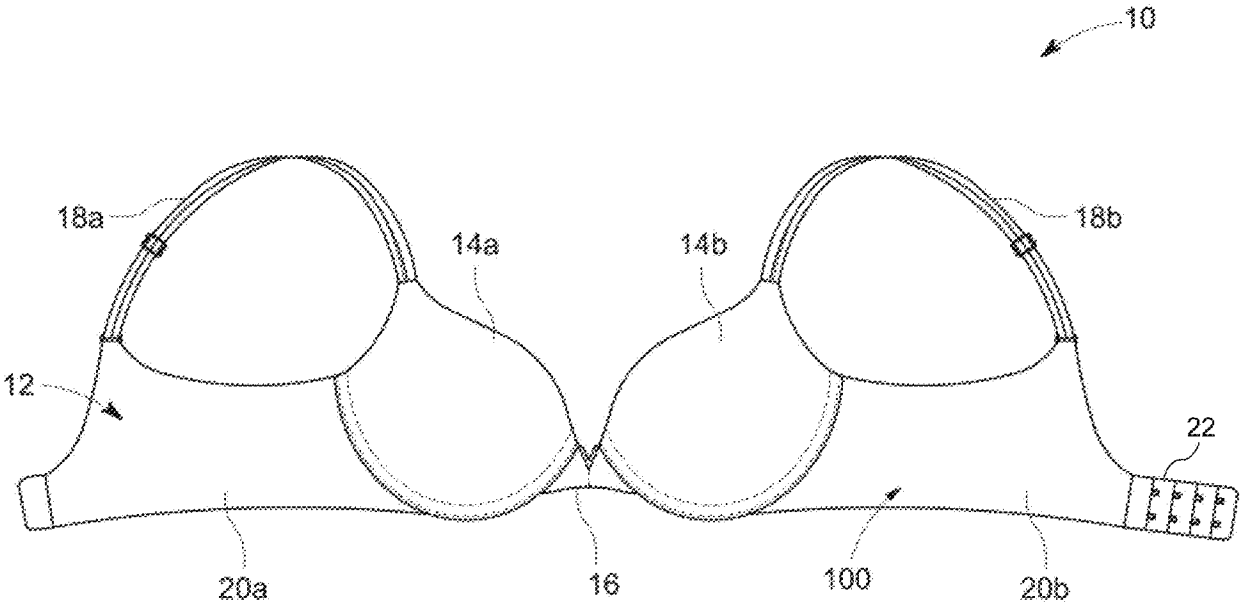
FIG. 1 illustrates a diagrammatic view of an article of clothing 10, in accordance with one or more embodiments of the present disclosure.

Referring to the drawings, FIG. 1 illustrates a diagrammatic view of an article of clothing 10, in accordance with one or more embodiments of the present disclosure. The article of clothing 10 may be any wearable clothing to be worn by a wearer. In the exemplary illustration of FIG. 1, the article of clothing 10 is shown to be a brassiere. The article of clothing 10 includes a body structure 12 which defines a shape of the article of clothing 10. In the exemplary article of clothing 10 of FIG. 1, the body structure 12 may include a pair of bra cups, with a first bra cup 14*a* and a second bra cup 14*b*. A center gore 16 may extend between and may connect the first bra cup 14*a* and the second bra cup 14*b*. A pair of straps, including a first strap 18*a* and a second strap 18*b* may be attached to peripheries of the first bra cup 14*a* and the second bra cup 14*b*, respectively. Further, a pair of side wings, including a first side wing 20*a* and a second side wing 20*b* may be attached to the peripheries of the first bra cup 14*a* and the second bra cup 14*b*, respectively. In one or more examples embodiments, one or more fasteners 22 may be provided on one or more of the first side wing 20*a* and the second side wing 20*b*. It may be contemplated that the pair of straps 18*a* and 18*b* support the article of clothing 10, being the brassiere, on shoulders of the wearer, while the pair of side wings 20*a* and 20*b* support the article of clothing 10 around a torso of the wearer. In some examples, the pair of straps 18*a* and 18*b* may not be provided and only the pair of side wings 20*a* and 20*b* may support the article of clothing 10 on the wearer.

Figure 2:
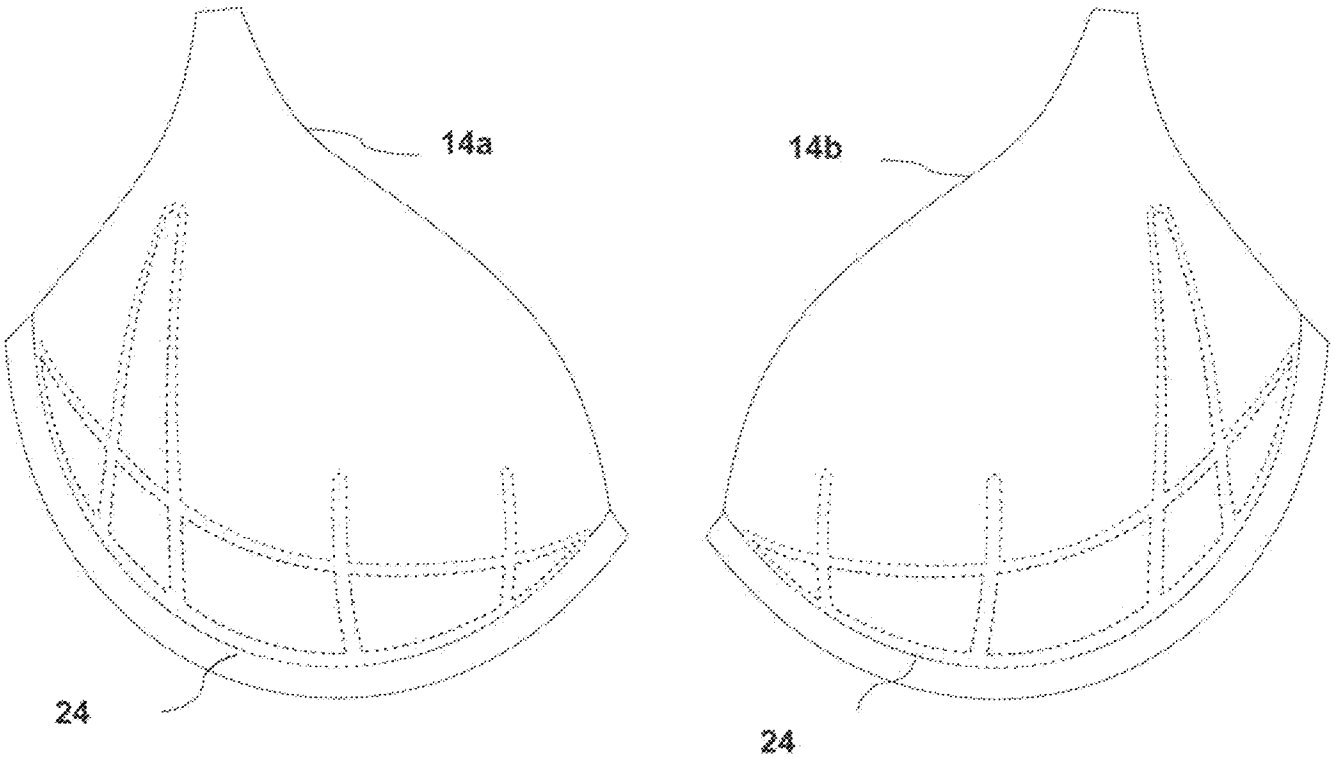
FIG. 2 illustrates a diagrammatic view of a pair of brassiere cups 14*a*, 14*b* with a pair of frames 24, in accordance with one or more embodiments of the present disclosure.

FIG. 2 illustrates a diagrammatic view of a pair of brassiere cups 14*a*, 14*b* with a pair of frames 24, in accordance with one or more embodiments of the present disclosure. As illustrated in FIG. 2, each of, or at least one of, the brassiere cups 14*a*, 14*b* comprises a frame 24. The frame 24 may be made up of one or more of Polypropylene (PP), Polyamide (PA), Thermoplastic Polyurethane (TPU), thermoplastic rubber (TPR), Polyoxymethylene (POM), or thermoplastic elastomers (TPE) material. Herein, thermoplastic elastomers (TPE), also sometimes referred to as thermoplastic materials or thermoplastic rubbers (TPR), are a class of copolymers or a physical mix of polymers (usually a plastic and a rubber) which consist of materials with both thermoplastic and elastomeric properties. Thermoplastic materials show advantages typical of both rubbery materials and plastic materials. The benefit of using thermoplastic materials is the ability to stretch to moderate elongations and return to its near original shape creating a longer life and better physical range than other materials. Examples of thermoplastic materials which are widely available in the market include, but not limited to, Hytrel, Dryflex, Mediprene, Kraton, Pibiflex, Sofprene, Laprene, Sofprene, Dryflex, Santoprene, Termoton, Solprene, etc., to name a few. Further, polyethylene (PE) is a thermoplastic polymer with variable crystalline structure. Polyethylene is light, versatile synthetic resin made from the polymerization of ethylene. Polyethylene is commonly categorized into one of several major compounds of which the most common include LDPE, LLDPE, HDPE, and Ultrahigh Molecular Weight Polypropylene. Other variants include Medium Density Polyethylene (MOPE), Ultra-low-molecular-weight polyethylene (ULMWPE or PE-WAX), High-molecular-weight polyethylene (HMWPE), High-density cross-linked polyethylene (HDXLPE), Cross-linked polyethylene (PEX or XLPE), Very-low-density polyethylene (VLDPE), and Chlorinated polyethylene (CPE).

In some example embodiments, each frame 24 may be providing support and maintaining the shape of each brassiere cups 14*a*, 14*b*. In some example embodiments, the frame 24 may comprise injection-molded thermoplastic material. In addition, the frame 24 includes a plurality of strip-shaped members, and the plurality of strip-shaped members include a bottom member, a connecting portion, and one or more projections or projection portions. In some exemplary embodiments, each strip-shaped member of the frame 24 may have a width of 2 mm to 20 mm and a thickness of 1 mm to 5 mm. In some example embodiments, limiting the width of a projection or a projection member of the frame 24 provides an optimally light-weight frame, and provides good air permeability.

Figure 3A:
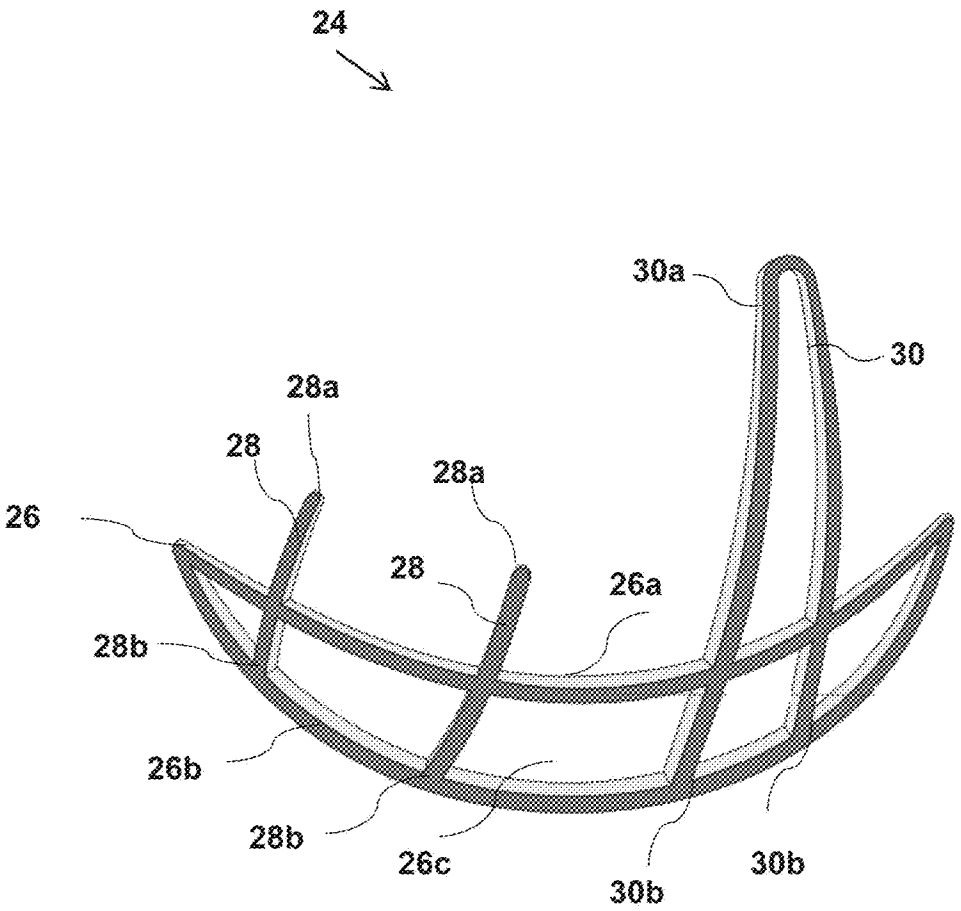
FIG. 3A illustrates a diagrammatic view of the frame 24, in accordance with one or more embodiments of the present disclosure.

FIG. 3A illustrates a diagrammatic view of the frame 24, in accordance with one or more embodiments of the present disclosure. The frame 24 may comprise a bottom member 26 that is located at a lower portion of a respective one of the brassiere cups 14*a*, 14*b*. The lower portion includes the region where a conventional underwire is located. It may also include the region where a conventional push-up pad is located. The lower portion is below the apex of the brassiere cup. An apex of a brassiere cup generally refers to the point or region where a shoulder strap is attached to the brassiere cup, and may also be known as the "ear" location of the brassiere cup. The bottom member 26 may comprise an upper member 26*a* and a lower member 26*b*. In some example embodiments, the upper member 26*a* and the lower member 26*b* may be connected at both ends and enclose/define a hollow crescent shape 26*c* therebetween. In some embodiments of the present disclosure, the frame 24 is provided in substitution of an underwire. In other words, an underwire may be absent in a brassiere cup in accordance with some embodiments of the present disclosure, since the bottom member 26, or at least the lower member 26*b*, may provide the function which a conventional underwire provides. In other embodiments, the bottom member 26 may be attachable to an underwire of a respective one of the brassiere cups 14*a*, 14*b*, and the frame 24 may be provided in addition to a conventional underwire provided within a brassiere cup.

In some example embodiments, as illustrated in FIG. 3A, the frame 24 may comprise at least one first projection 28. The at least one first projection 28 may originate from the lower member 26*b* and extend beyond the upper member 26*a*. In some example embodiments, the upper member 26*a* of the bottom member 26 may be configured to support a brassiere pad of the respective one of the brassier cups 14*a*, 14*b*. In some example embodiments, the lower member 26*b* of the bottom member 26 may be configured to support a lower portion, or at least the bottom of a lower portion, of the respective one of the brassiere cups 14*a*, 14*b*. The bottom of the lower portion of a brassiere cup is usually where a conventional underwire is located.

In some example embodiments, the at least one first projection 28 may be connected to each or any one of the upper member 26*a* and the lower member 26*b*. Additionally, referring to FIG. 3A, one end 28*b* of the at least one first projection 28 may be connected to the lower member 26*b* and the other end 28*a* of the at least one first projection 28 may lie beyond the upper member 26*a*. In some example embodiments, the at least one first projection 28 may be configured to support and maintain the respective one of the brassiere cups 14*a*, 14*b*.

In some example embodiments, the frame 24 may comprise at least one second projection 30. The at least one second projection 30 may extend from the lower member 26*b* towards an apex of the respective one of the brassiere cups 14*a*, 14*b*. In some example embodiments, as illustrated in FIG. 3A, the at least one second projection 30 may be connected to each or any one of the upper member 26*a* and the lower member 26*b*. In some example embodiments, one end 30*b* of the at least one second projection 30 may be connected to the lower member 26*b* and the other end 30*a* of the at least one second projection 30 may extend towards the apex of the respective one of the brassiere cups 14*a*, 14*b*. The at least one second projection 30 may be connected to, or be configured to extend across and beyond, the apex of the respective one of the brasserie cups 14*a*, 14*b*. In some example embodiments, the at least one second projection 30 is longer than the at least one first projection 28. Additionally, the at least one second projection 30 may be configured to support an upper portion of the respective one of the brassiere cups 14*a*, 14*b*.

Figure 3B:
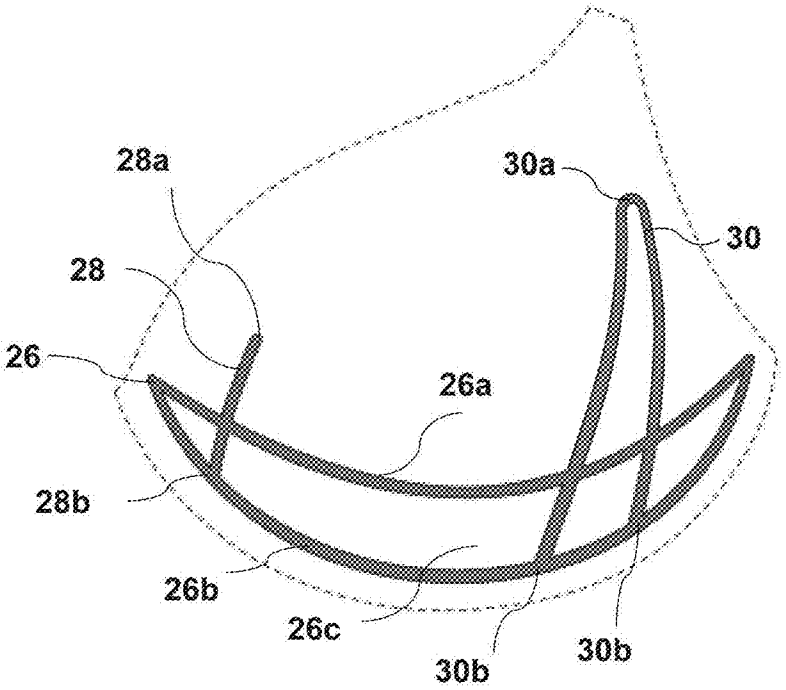
FIG. 3B illustrates a diagrammatic view of the frame 24 with a single first projection 28, in accordance with one or more embodiments of the present disclosure.

FIG. 3B illustrates a diagrammatic view of the frame 24 with a single first projection 28, in accordance with one or more embodiments of the present disclosure. In some example embodiments, the first projection 28 may originate from the lower member 26*b* and extends beyond the upper member 26*a*. In some example embodiments, the first projection 28 may be connected to each of the upper member 26*a* and the lower member 26*b*. Additionally, referring to FIG. 3B, one end 28*b* of the first projection 28 may be connected to the lower member 26*b* and the other end 28*a* of the first projection 28 may lie beyond the upper member 26*a*. In some example embodiments, the frame 24 may comprise at least one second projection 30. The at least one second projection 30 may extend from the lower member 26*b* towards an apex of the respective one of the brassiere cups 14*a*, 14*b*. In some example embodiments, as illustrated in FIG. 3B, the at least one second projection 30 may be connected to each or any one of the upper member 26*a* and the lower member 26*b*. In some example embodiments, one end 30*b* of the at least one second projection 30 may be connected to the lower member 26*b* and the other end 30*a* of the at least one second projection 30 may extend towards and/or beyond the apex of the respective one of the brassiere cups 14*a*, 14*b*.

Figure 3C:
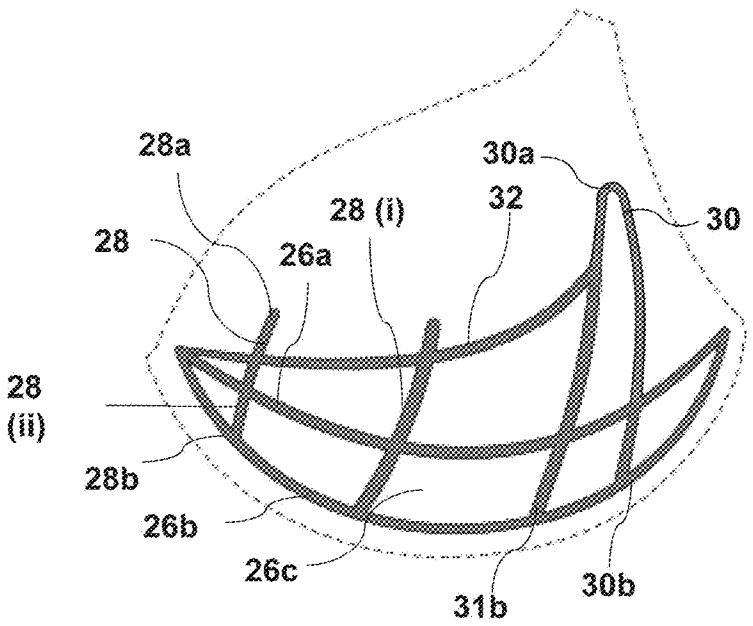
FIG. 3C illustrates a diagrammatic view of the frame with a connecting member 32, in accordance with one or more embodiments of the present disclosure.

FIG. 3C illustrates a diagrammatic view of the frame with a connecting member 32, in accordance with one or more embodiments of the present disclosure. As illustrated in FIG. 3C, the frame 24 may comprise two first projections 28(*i*), 28(*ii*). In some example embodiments, the first projection 28 may comprise a first projection member 28(*i*) and a second projection member 28(*ii*). The one end of each of the first projection member 28(*i*) and the second projection member 28(*ii*) is connected to the lower member 26*b* at separate points and the other end of each of the first projection member 28(*i*) and the second projection member 28(*ii*) extend beyond the upper member 26*a*.

In some example embodiments, the first projection member 28(*i*) and the second projection member 28(*ii*) are spaced apart from each other. Additionally, a connecting member 32 may connect the at least one second projection 30, the first projection member 28(*i*) and the second projection member 28(*ii*). The connecting member 32 may be providing additional support for the frame 24.

Figure 3D:
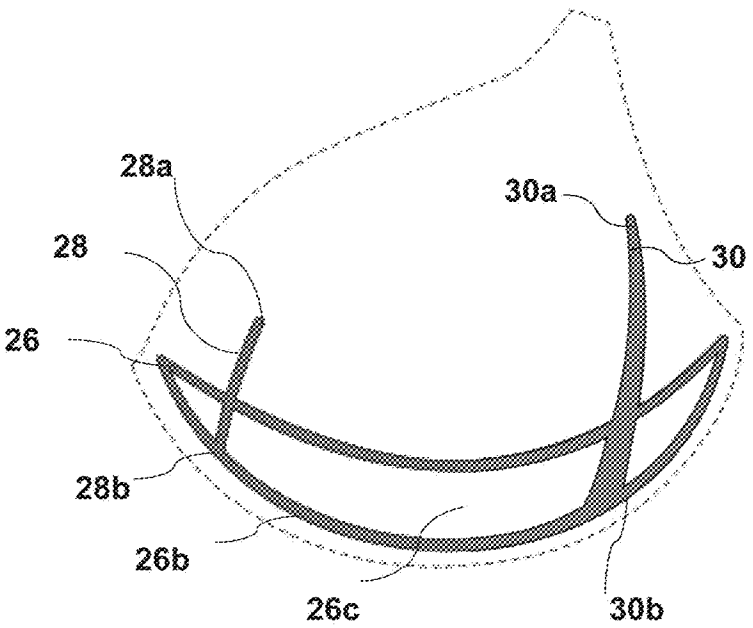
FIG. 3D illustrates a diagrammatic view of the frame 24 with a single first projection 28 and a single second projection 30, in accordance with one or more embodiments of the present disclosure.

FIG. 3D illustrates a diagrammatic view of the frame with the single first projection 28 and the single second projection 30, in accordance with one or more embodiments of the present disclosure. In some example embodiments, the frame 24 may comprise a single first projection 28. The first projection 28 may originate from the lower member 26*b* and extends beyond the upper member 26*a*. In some example embodiments, the first projection 28 may be connected to each or any one of the upper member 26*a* and the lower member 26*b*. Additionally, one end 28*b* of the first projection 28 may be connected to the lower member 26*b*. The other end 28*a* of the first projection 28 may lie beyond the upper member 26*a*.

In some example embodiments, the frame 24 may comprise a single second projection 30. The second projection 30 may extend from the lower member 26*b* towards an apex of one of the brassiere cups 14*a*, 14*b*. In some example embodiments, as illustrated in FIG. 3D, the second projection 30 may be connected to each or any one of the upper member 26*a* and the lower member 26*b*. In some example embodiments, one end 30*b* of the second projection 30 may be connected to the lower member 26*b* and the other end 30*a* of the second projection 30 may extend towards and/or beyond the apex of one of the brassiere cups 14*a*, 14*b*.

Figure 3E:
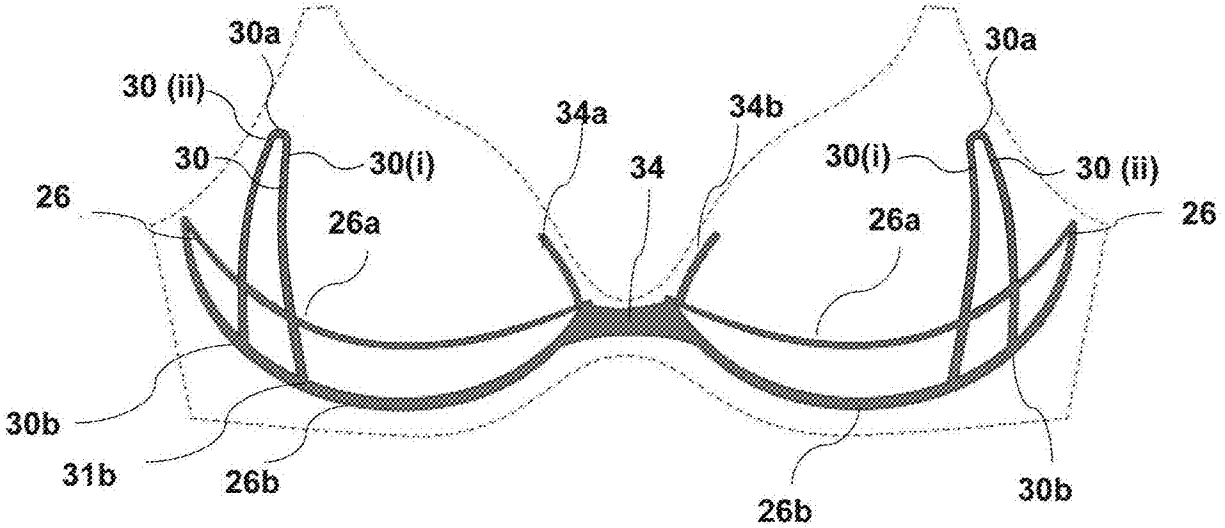
FIG. 3E illustrates a diagrammatic view of a pair of frames 24 with a connecting bridge 34 between the frames 24, in accordance with one or more embodiments of the present disclosure.

FIG. 3E illustrates a diagrammatic view of a pair of frames 24 with a connecting bridge 34 between the frames, in accordance with one or more embodiments of the present disclosure. In some example embodiments, the pair of frames 24 may comprise two second projection members 30(*i*), 30(*ii*). In some example embodiments, as illustrated in FIG. 3E, the second projection 30 comprises a first projection member 30(*i*) and a second projection member 30(*ii*).

In some example embodiments, one end of each of the first projection member 30 (*i*) and the second projection member 30(*ii*) may be connected to the lower member 26*b* and the other ends of the first projection member 30(*i*) and the second projection member 30(*ii*) are connected, preferably forming a rounded corner. Additionally, a connecting bridge 34 may connect the pair of frames 24 through the center gore of the respective one of the brassiere cups 14*a*, 14*b*. Further the connecting bridge 34 may comprise a pair of projections 34*a*, 34*b* which may be directed towards each frame 24, and/or which may extend along at least a portion of the neckline.

Figure 3F:
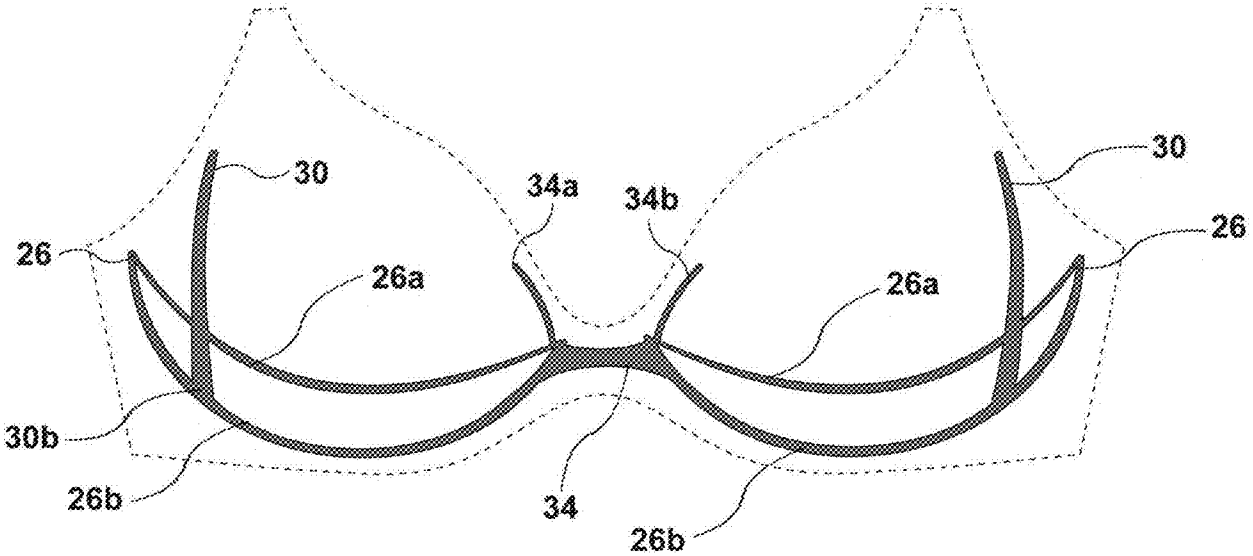
FIG. 3F illustrates a diagrammatic view of a pair of frames 24 with a single second projection 30 in accordance with one or more embodiments of the present disclosure.

FIG. 3F illustrates a diagrammatic view of a pair of frames 24 with a single second projection 30 for each of the brassiere cups in accordance with one or more embodiments of the present disclosure. In some example embodiments, the pair of frames 24 may comprise a single second projection 30. The second projection 30 may be extending from the lower member 26*b* towards and/or beyond the apex of the respective one of the brassiere cups. In some example embodiments, as illustrated in FIG. 3F, the second projection 30 may be connected to each or any one of the upper member 26*a* and the lower member 26*b*. Additionally, a connecting bridge 34 may connect the pair of frames 24 through the center gore of the respective one of the brassiere cups 14*a*, 14*b*. Further, the connecting bridge 34 may comprise a pair of projections 34*a*, 34*b* directing towards each frames 24, and/or which may extend along at least a portion of the neckline.

Figure 3G:
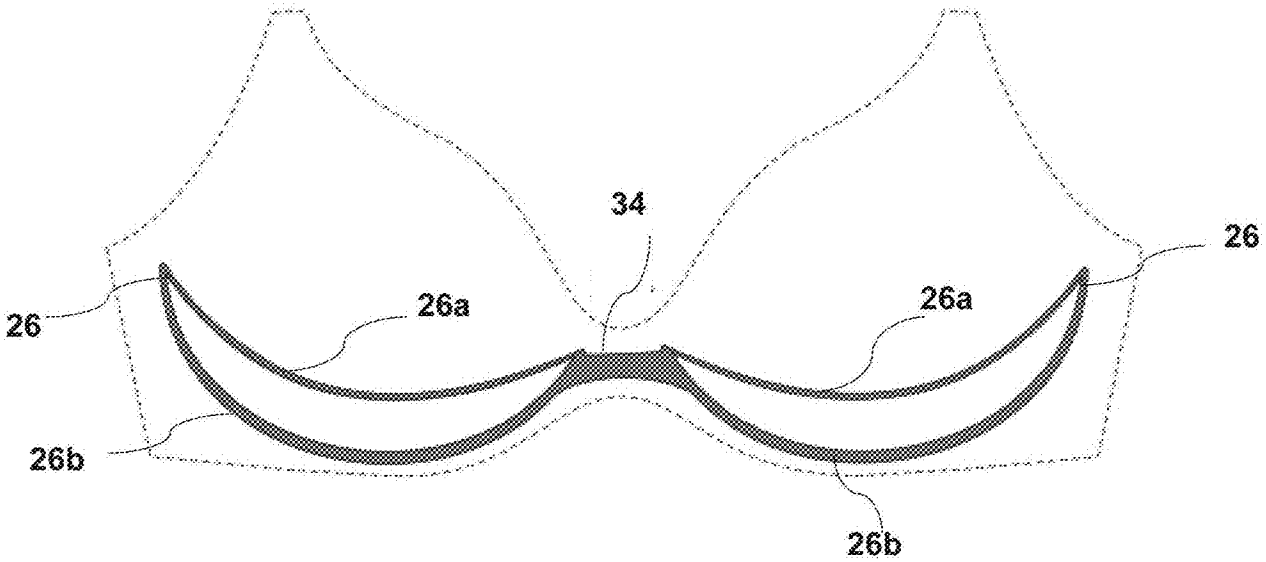
FIG. 3G illustrates a diagrammatic view of a pair of frames 24 with the bottom member 26 in accordance with one or more embodiments of the present disclosure.

FIG. 3G illustrates a diagrammatic view of a pair of frames 24 with a bottom member 26 in accordance with one or more embodiments of the present disclosure. The pair of bottom members 26 comprises a connecting bridge which may connect the pair of frames 24. As illustrated in FIG. 3G, the pair of bottom members 26 may support the respective one of the brassiere cups 14*a*, 14*b* without first projection 28 and second projection 30. The pair of frames may function in substitution of or in addition to a conventional underwire.

Figure 3I:
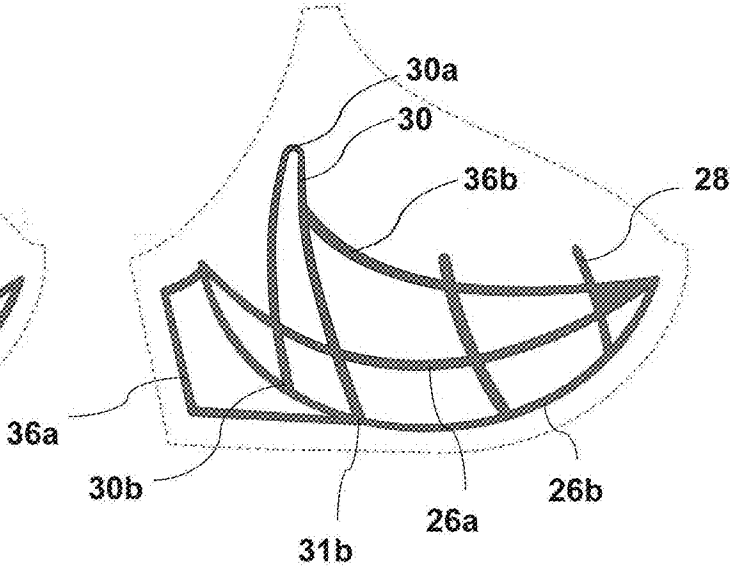
FIG. 3H and FIG. 3I illustrate a diagrammatic view of a pair of frames 24 with a plurality of connecting members 36*a*, 36*b* in accordance with one or more embodiments of the present disclosure.
Figure 3H:
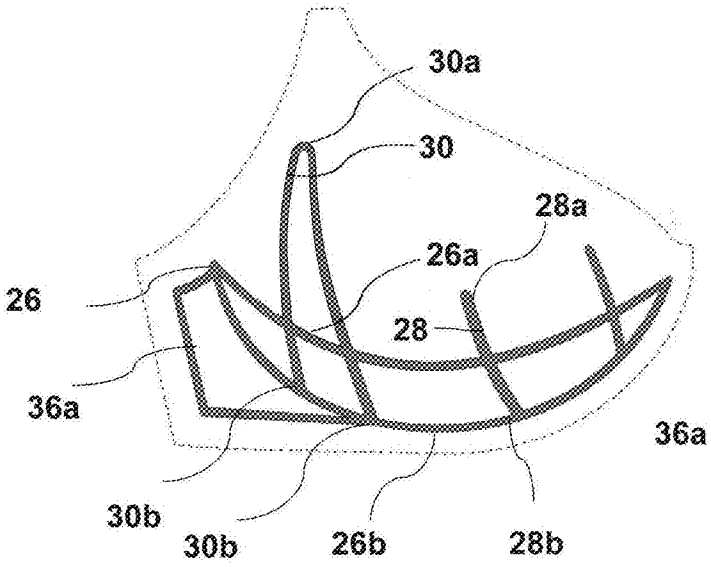

FIG. 3H and FIG. 3I illustrate diagrammatic frames 24 with a plurality of connecting members 36*a*, 36*b* in accordance with one or more embodiments of the present disclosure. Referring to FIG. 3H, a connecting member 36*a* may connect the bottom member 26 and the bottom of the second projection 30*b*. The connection may provide additional support to the bottom member of the respective one of the brassiere cups 14*a*, 14*b*. In an alternative example embodiment, as illustrated in FIG. 3I, the other connecting member 36*b* may connect bottom member 26, the at least one first projection 28, and the at least one second projection 30. The additional connecting members 36*a*, 36*b*, as illustrated in the FIG. 3H and FIG. 3I, enhances the support to the respective one of the brassiere cups 14*a*, 14*b*.

Figure 3J:
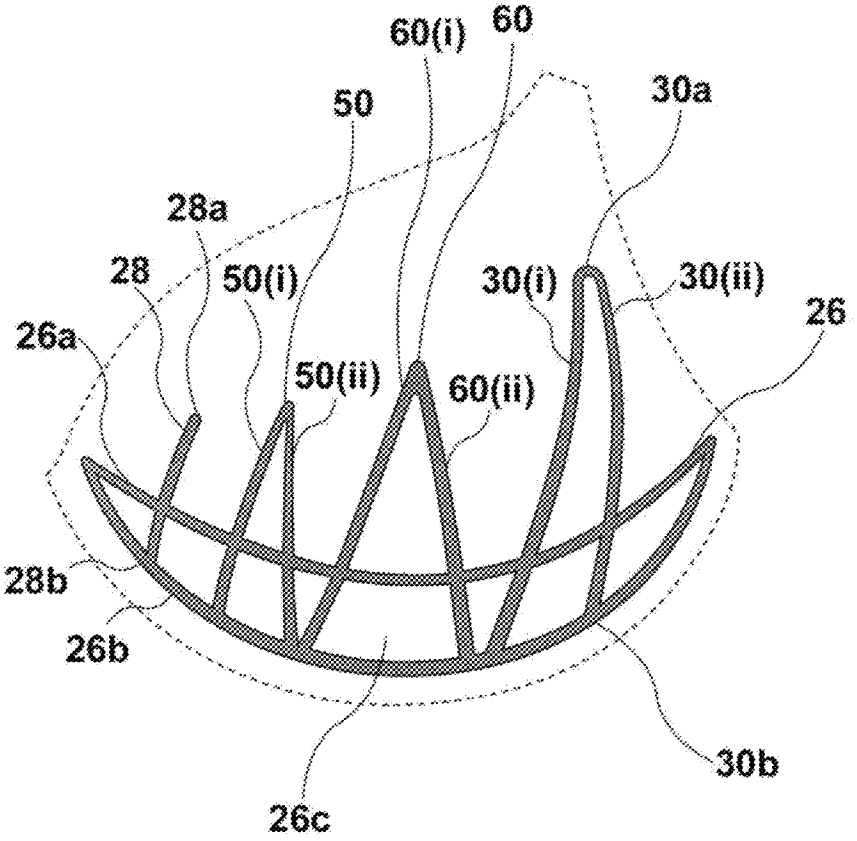
FIG. 3J illustrates a diagrammatic view of the frame 24 in accordance with one or more embodiments of the present disclosure.

FIG. 3J illustrates a diagrammatic view of the frame 24 in accordance with one or more embodiments of the present disclosure. In some example embodiments, as illustrated in FIG. 3J, the frame 24 may comprise three first projections 28, 50, 60. The first projection 28 may comprise a single projection member. The second first projection 50 may comprise a first projection member 50(*i*) and a second projection member 50(*ii*). The one end of each of the first projection member 50(*i*) and the second projection member 50(*ii*) is connected to the lower member 26*b* at separate points and the other ends of each of the first projection member 50(*i*) and the second projection member 50(*ii*) extend beyond the upper member 26*a* and are connected. In some example embodiments, the third first projection 60 may comprise a first projection member 60(*i*) and a second projection member 60(*ii*). The one end of each of the first projection member 60(*i*) and the second projection member 60(*ii*) is connected to the lower member 26*b* at separate points and the other ends of each of the first projection member 60(*i*) and the second projection member 60(*ii*) extend beyond the upper member 26*a* and are connected.

In some example embodiments, the pair of frames 24 may comprise two second projections 30(*i*), 30(*ii*). In some example embodiments, as illustrated in FIG. 3J, the second projection 30 comprises a first projection member 30(*i*) and a second projection member 30(*ii*). In some example embodiments, one end of each of the first projection member 30 (*i*) and the second projection member 30(*ii*) may be connected to the lower member 26*b* and the other ends of the first projection member 30(*i*) and the second projection member 30(*ii*) are connected, preferably forming a rounded corner.

Figure 4:
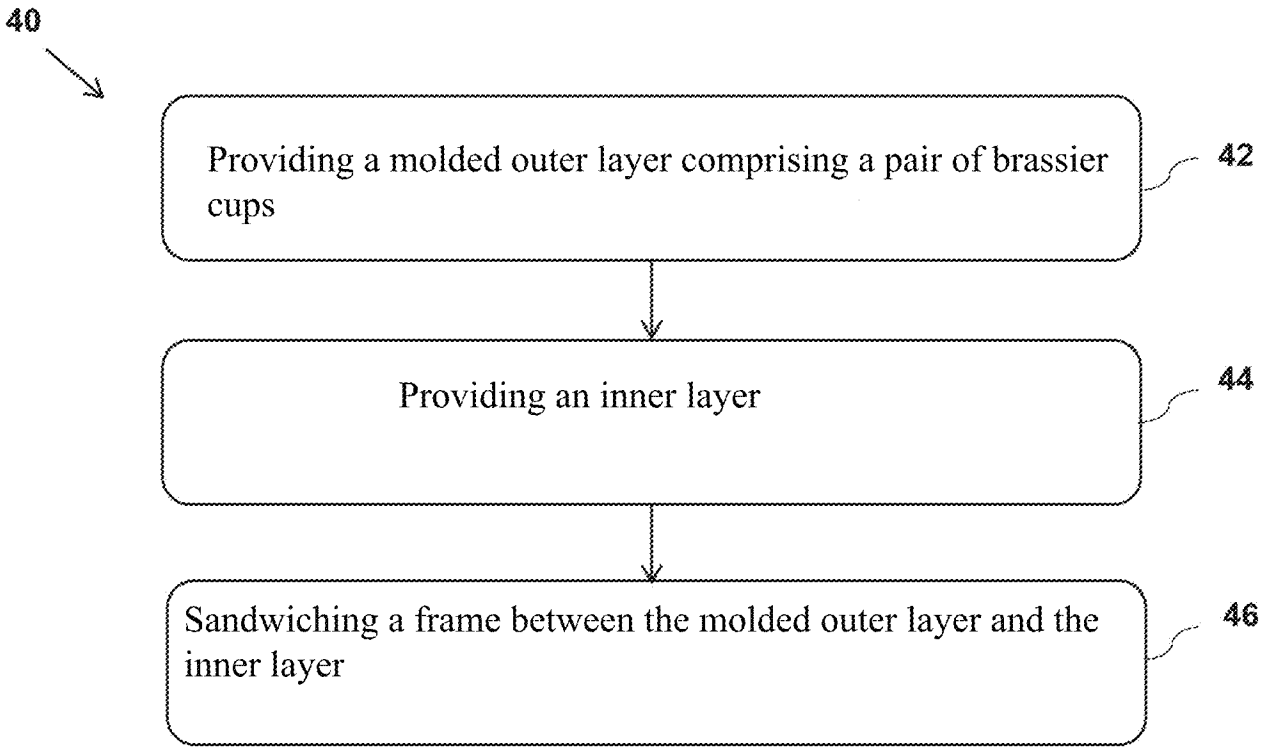
FIG. 4 illustrates a method of manufacturing an article of clothing in accordance with one or more embodiments of the present disclosure.

FIG. 4 illustrates a method of manufacturing an article of clothing in accordance with one or more embodiments of the present disclosure. The method comprises at step 42, a molded first layer, which is preferably the outer layer, is provided. The molded first layer may comprise a single brassiere cup or a pair of brassier cups. The molded first layer may comprise a fabric layer and a laminated foam material. At step 44, a second layer, which is preferably the inner layer, is provided. At step 46, sandwiching a frame between the molded first or outer layer and the second or inner layer. The frame 24 may comprise a bottom member 26 attachable to an underwire of a respective one of the brassiere cups. The frame 24 may be provided in addition to a conventional underwire or in substitution of a conventional underwire, and in the latter case an underwire is absent in the brassiere cup. The bottom member 26 may further comprise a upper member and a lower member. The frame may further comprise at least one first projection 28. The at least one first projection 28 originates from the lower member 26*b* and extends beyond the upper member 26*a*. Further, the frame comprises at least one second projection 30. The at least one second projection 30 extends from the lower member 26*b* towards and/or beyond an apex of the respective one of the brassiere cups 14*a*, 14*b*.

In some of the embodiments described in the foregoing, the at least one first projection 28 is closer than the at least one second projection 30 to the neckline and/or the center gore of the brassiere, and provides support and resistance to the forces applied to the center gore when the brassiere is worn. The at least one second projection 30 is closer than the at least one first projection 28 to the underarm region and/or the apex of the respective one of the brassiere cups 14*a*, 14*b*, and provides support and resistance to the forces applied to respectively the apex and the cup side where the side wing is attached when the brassiere is worn. In some embodiments, the at least one first projection 28 comprises a first projection member 28(*i*) and a second projection member 28(*ii*). One end of each of the first projection member 28(*i*) and the second projection member 28(*ii*) is connected to the lower member and the other ends of the first projection member 28(*i*) and the second projection member 28(*ii*) are connected, preferably forming an acute corner. In some embodiments, the at least one second projection 30 comprises a first projection member 30(*i*) and a second projection member 30(*ii*). One end of each of the first projection member 30(*i*) and the second projection member 30(*ii*) is connected to the lower member and the other ends of the first projection member 30(*i*) and the second projection member 30(*ii*) are connected, preferably forming a rounded corner 30*a*. Because the at least one second projection 30 is longer than the at least one first projection 28, the rounded corner 30*a* helps to prevent inadvertent piercing of the fabric layer(s) covering the frame 24 which may be caused by an otherwise sharp or an acute corner.

Figure 5A:
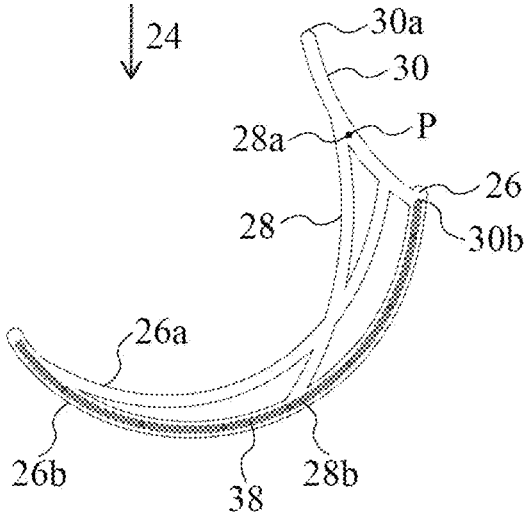
FIG. 5A shows a schematic diagram of the frame 24 according to one or more embodiments of the present disclosure.

FIG. 5A shows a schematic diagram of the frame 24 according to one or more embodiments of the present disclosure. The frame 24 may include a bottom member 26 located at a lower portion of a corresponding one of the brassiere cups 14*a*, 14*b*. The bottom member 26 may include an upper member 26*a* and a lower member 26*b*. In some exemplary embodiments, one end of the upper member 26*a* and one end of the lower member 26*b* may be connected at a location of the corresponding brassiere cup that is close to the center gore. The upper member 26*a* and the lower member 26*b* of the frame 24 can provide a lateral force-bearing structure to provide better support and comfort.

In some exemplary embodiments, the frame 24 may include a first projection 28. The first projection 28 may originate from the lower member 26*b* and extend beyond the upper member 26*a*. In some exemplary embodiments, the upper member 26*a* of the bottom member 26 may be configured as a bra cushion supporting a corresponding one of the brassiere cups 14*a*, 14*b*. In some exemplary embodiments, the lower member 26*b* of the bottom member 26 may be configured to support the lower portion of a corresponding one of the brassiere cups 14*a*, 14*b*, or at least the bottom of the lower portion. The bottom of the lower portion of the brassiere cup is usually located at the position of a conventional underwire.

In some exemplary embodiments, the first projection 28 may be connected to each or any of the upper member 26*a* and the lower member 26*b*. Referring to FIG. 5A, one end 28*b* of the first projection 28 may be connected to the lower member 26*b*, and the other end 28*a* of the first projection 28 may extend beyond the upper member 26*a*. In some exemplary embodiments, the other end 28*a* of the first projection 28 may extend toward the apex (also known as the "ear" position) of a corresponding one of the brassiere cups 14*a*, 14*b*. In some exemplary embodiments, the first projection 28 may be configured to support and hold a corresponding one of the brassiere cups 14*a*, 14*b*. The first projection 28 can provide a vertical force-bearing structure, so that the clothing has a better side-pushing concentration effect.

In some exemplary embodiments, the frame 24 may include a second projection 30. The second projection 30 may extend from the lower member 26*b* to the apex of a corresponding one of the brassiere cups 14*a*, 14*b*. In some exemplary embodiments, the second projection 30 may be connected to each or any of the upper member 26*a* and the lower member 26*b*. In some exemplary embodiments, one end 30*b* of the second projection 30 may be connected to the lower member 26*b*, and the other end 30*a* of the second projection 30 may extend toward the apex of a corresponding one of the brassiere cups 14*a*, 14*b*. The second projection 30 may be connected to or configured to extend through and beyond the apex of a corresponding one of the brassiere cups 14*a*, 14*b*.

In some exemplary embodiments, the other end 28*a* of the first projection 28 intersects with the second projection 30 at a point P as shown in FIG. 5A. As shown in FIG. 5A, the intersection point P is higher than one end 30*b* of the second projection 30 and lower than the other end 30*a* of the second projection 30. In other words, the other end 28*a* of the first projection 28 is connected to the second projection 30 at point P. The other end 30*a* of the second projection 30 is closer to the apex of a corresponding one of the pair of brassiere cups than the other end 28*a* of the first projection 28. The other end 30*a* of the second projection 30 is closer to the underarm region of a corresponding one of the pair of brassiere cups than the other end 28*a* of the first projection 28. The second projection 30 may be configured to support the upper portion of a corresponding one of the brassiere cups 14*a*, 14*b*. The second projection 30 of the frame 24 can provide a vertical force-bearing structure, so that the clothing has a better side-pushing concentration effect. In other embodiments, the frame 24 may include a plurality of first projections 28 and a plurality of second projections 30.

The above-described bottom member 26 of the frame 24, the at least one of the plurality of first projections 28, and the at least one of the plurality of second projections 30 may be integrally formed.

The frame 24 may be made of one or more of thermoplastic elastomer (SEBS), thermoplastic polyurethane (TPU), thermoplastic rubber (TPR), silicone resin, or thermoplastic elastomer (TPE) materials. In some embodiments of the present invention, the frame 24 is provided to substitute an underwire. In other words, according to some embodiments of the present invention, the underwire may not be present in the brassiere cup because the bottom member 26 or at least the lower member 26*b* can provide the functions provided by a conventional underwire. In other embodiments, the bottom member 26 may be attached to the underwire of a corresponding one of the brassiere cups 14*a*, 14*b*, and the frame 24 may also be provided in addition to providing a conventional underwire in the brassiere cup.

In an exemplary embodiment, the frame 24 may further include a core member 38 provided inside the lower member 26*b*. The core member 38 is completely encased in the lower member 26*b*. The length of the core member 38 may be less than or equal to the length of the lower member 26*b*. The core member 38 may be a conventional underwire.

The core member 38 may be made of one or more of polypropylene (PP), polyamide (PA), thermoplastic polyurethane (TPU), thermoplastic rubber (TPR), polyoxymethylene (POM), or thermoplastic elastomer (TPE) materials. The core member 38 and the bottom member 26, the first projection 28, and the second projection 30 of the frame 24 may be made of the same or different materials. However, the core member 38 and the bottom member 26, the first projection 28, and the second projection 30 of the frame 24 should have different hardness. Specifically, the hardness of the bottom member 26, the first projection 28, and the second projection 30 of the frame 24 should be lower than the hardness of the core member 38, because the upper portion of the brassiere cup requires less support and better comfort and flexibility. Also, the core member 38 having a greater hardness can provide stronger support to the lower portion of a corresponding one of the brassiere cups 14*a*, 14*b*. On the other hand, the core member 38 having a greater hardness is encased in the bottom member 26 of the frame 24 which has a less hardness, which makes it less easy for the core member 38 to pierce the fabric portion of the clothing when the clothing is repeatedly used or washed.

Figure 6A:
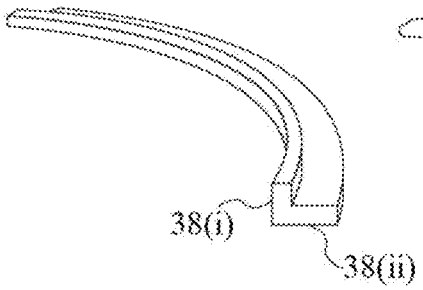
FIGS. 6A to 6E show schematic diagrams of the core member 38 in the frame 24 according to one or more embodiments of the present disclosure.
Figure 6B:
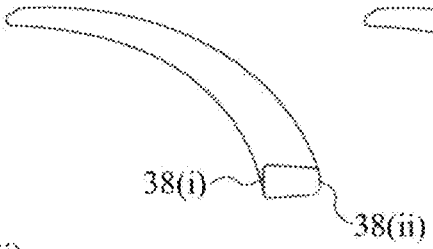
Figure 6C:
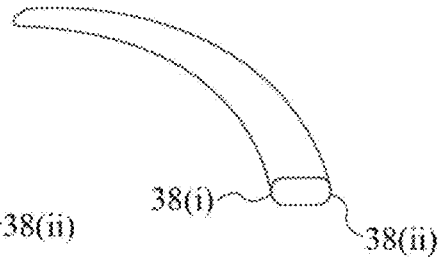

In an exemplary embodiment, in order to provide better support for the breast, the cross-sectional shape of the core member 38 may be an L shape as shown in FIG. 6A or may form an appropriate angle (not necessarily 90 degrees). When worn, the short-leg side 38(*i*) of an L-shaped core member 38 is close to the breast, and the long-leg side 38(*ii*) is close to the torso, so as to provide better support to the breast. In an exemplary embodiment, as shown in FIG. 6B, the width of an upper arc 38(*i*) of the core member 38 may be greater than the width of a lower arc 38(*ii*) so as to provide better support for the breast. Here, the upper arc refers to the side of the core member 38 that faces upwards (or is closer to the wearer's head) when the bra is worn, and the lower arc refers to the side of the core member 38 that faces downwards (or is closer to the wearer's feet) when the bra is worn and that is opposite the upper arc. In an exemplary embodiment, as shown in FIG. 6C, the width of the upper arc 38(*i*) of the core member 38 may be the same as the width of the lower arc 38(*ii*).

Figure 6D:
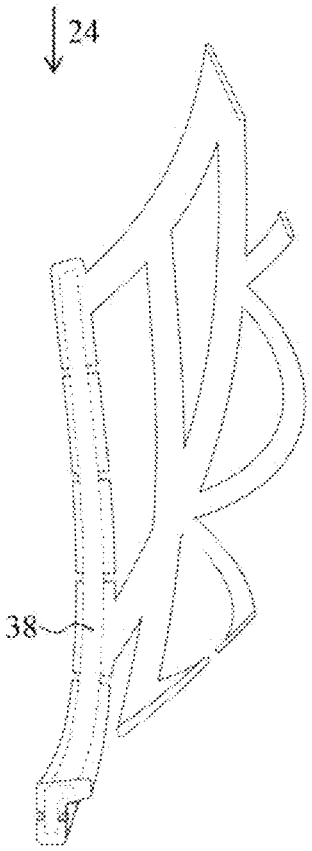
Figure 6E:
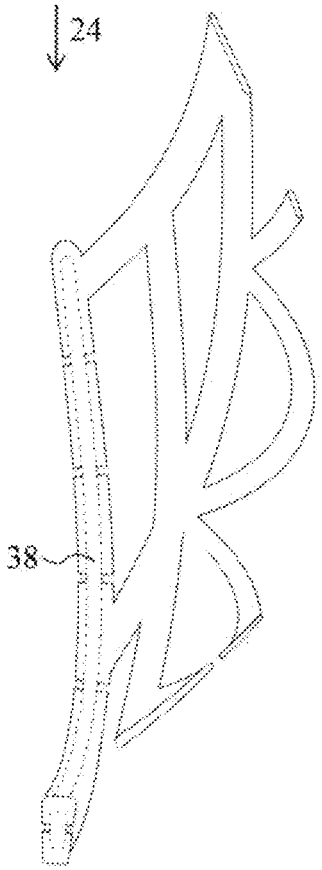

FIGS. 6D and 6E show the core member 38 placed in the frame. Here, the core member 38 shown in FIG. 6D is L-shaped, and the width of the upper arc of the core member 38 shown in FIG. 6E is greater than width of the lower arc.

In an exemplary embodiment, the frame 24 may not include the core member 38, which is not limiting. The frame 24 has a three-dimensional (3D) shape and conforms to the shape of a corresponding one of the brassiere cups 14*a*, 14*b* to fit inside the corresponding one of the brassiere cups 14*a*, 14*b*.

Figure 5B:
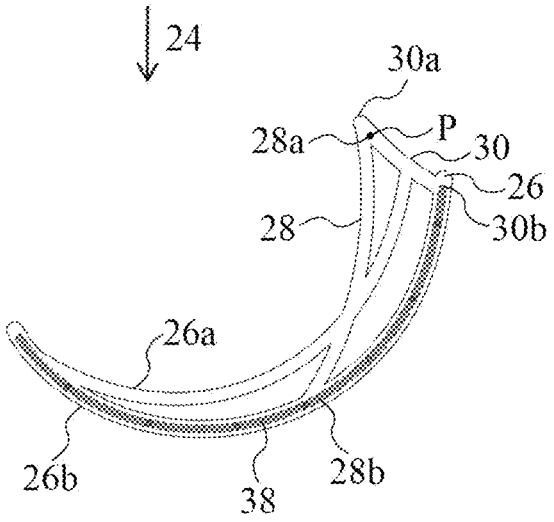
FIG. 5B shows a schematic diagram of the frame 24 according to one or more embodiments of the present disclosure.

FIG. 5B shows a schematic diagram of the frame 24 according to one or more embodiments of the present disclosure. The frame 24 shown in FIG. 5B is similar to the frame 24 in FIG. 5A. In an exemplary embodiment, the frame 24 may include a bottom member 26 located at a lower portion of a corresponding one of the brassiere cups 14*a*, 14*b*. The bottom member 26 may include an upper member 26*a* and a lower member 26*b*. In an exemplary embodiment, the core member 38 may be provided inside the lower member 26*b*, and the lower member 26*b* completely encloses the core member 38. The core member 38 in FIG. 5B is similar to the core member 38 in FIG. 5A and will not be repeated here.

The frame 24 may include a first projection 28. The first projection 28 may originate from the lower member 26*b* and extend beyond the upper member 26*a*. One end 28*b* of the first projection 28 may be connected to the lower member 26*b*, and the other end 28*a* of the first projection 28 may extend beyond the upper member 26*a* toward the apex of a corresponding one of the brassiere cups 14*a*, 14*b*. In some exemplary embodiments, the frame 24 may include a second projection 30. The second projection 30 may extend from the lower member 26*b* toward the apex of a corresponding one of the brassiere cups 14*a*, 14*b*. One end 30*b* of the second projection 30 may be connected to the lower member 26*b*, and the other end 30*a* of the second projection 30 may extend toward the apex of a corresponding one of the brassiere cups 14*a*, 14*b*. In some exemplary embodiments, the other end 28*a* of the first projection 28 and the other end 30*a* of the second projection 30 intersect at the point P shown in FIG. 5B, and the first projection 28 and the second projection 30 both stop extending upward at point P.

Figure 5C:
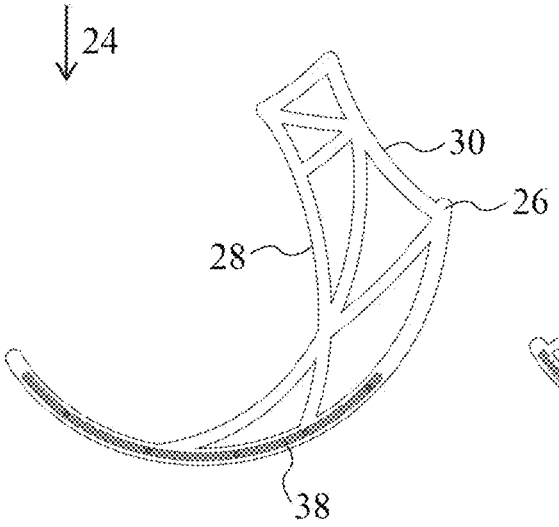
FIG. 5C shows a schematic diagram of the frame 24 according to one or more embodiments of the present disclosure.

FIG. 5C shows a schematic diagram of the frame 24 according to one or more embodiments of the present disclosure. The frame 24 shown in FIG. 5C is similar to the frame 24 shown in FIGS. 5A and 5B. In the frame 24 shown in FIG. 5C, in addition to the bottom member 26, the first projection 28, the second projection 30, and the core member 38 described above, it may also include a plurality of strip-shaped members interleaved between the bottom member 26, the first projection 28 and the second projection 30. The bottom member 26, the first projection 28, the second projection 30, and the above-described plurality of strip-shaped members of the frame 24 in FIG. 5C may be integrally formed. The frame 24 shown in FIG. 5C is suitable for a "larger size" bra where the width of the shoulder straps may be greater.

Figure 5D:
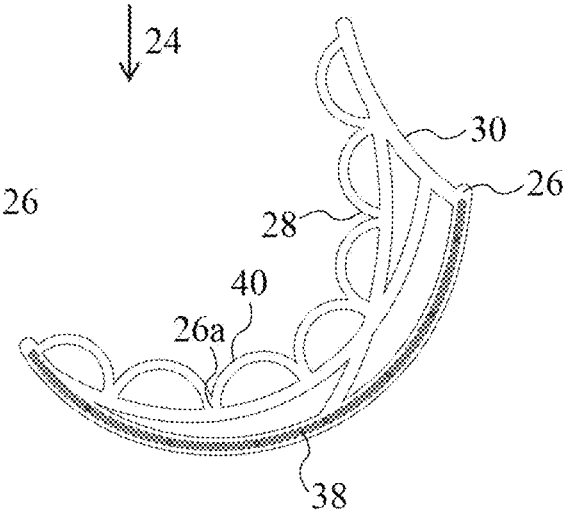
FIG. 5D shows a schematic diagram of the frame 24 according to one or more embodiments of the present disclosure.

FIG. 5D shows a schematic diagram of the frame 24 according to one or more embodiments of the present disclosure. The frame 24 shown in FIG. 5D is similar to the frame 24 shown in FIGS. 5A to 5C. In the frame 24 shown in FIG. 5D, in addition to the bottom member 26, the first projection 28, the second projection 30, and the core member 38 described above, the frame 24 may further include a middle member 40. The middle member 40 may be located above the upper member 26*a* at a position where a bra pad of a corresponding one of the pair of brassiere cups is located, so as to support the bra pad. The middle member 40 may also be located on the portion of the first projection 28 that extends beyond the upper member 26*a* at a position where a bra pad of a corresponding one of the pair of brassiere cups is located, so as to support the bra pad. The middle member 40 may be connected to the upper member 26*a* and/or the first projection 28 and/or the second projection 30.

In an exemplary embodiment, the middle member 40 has a wave shape to better release the pressure on the breast and achieve a better push-up effect. In an exemplary embodiment, the middle member 40 may comprise a plurality of arcs arranged in close contact with each other. However, the middle member 40 may also be formed of other shapes, not limited to the arc shape in this embodiment. The middle member 40 may be made of one or more of polypropylene (PP), polyamide (PA), thermoplastic polyurethane (TPU), thermoplastic rubber (TPR), polyoxymethylene (POM) or thermoplastic elastomer (TPE) materials.

The bottom member 26, the first projection 28, the second projection 30, the core member 38, and the middle member 40 of the frame 24 in FIG. 5D may be integrally formed. Further, the bottom member 26, the first projection 28, the second projection 30, the core member 38, and the middle member 40 of the frame 24 may be generally strip-shaped or formed from strip-shaped strips. The width of a strip is about 5 mm or between 2 mm and 20 mm, and the thickness is about 1 mm or between 0.5 mm and 3 mm. The lower member 26*b* of the frame 24 need not have a flat outer surface. For example, the lower member 26*b* may be a bulged member in order to encase the core member 38 or a conventional underwire.

Figure 5E:
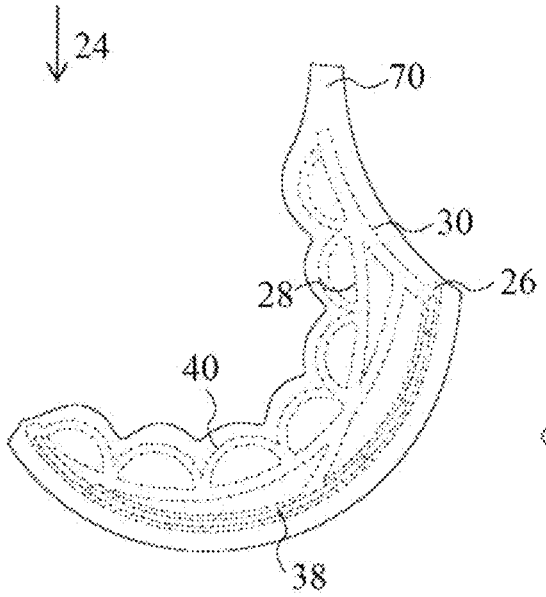
FIG. 5E shows a schematic diagram of the frame 24 according to one or more embodiments of the present disclosure.

FIG. 5E shows a schematic diagram of the frame 24 according to one or more embodiments of the present disclosure. The frame 24 shown in FIG. 5E is similar to the frame 24 shown in FIG. 5D.

In the frame 24 shown in FIG. 5E, in addition to the bottom member 26, the first projection 28, the second projection 30, the core member 38, and the middle member 40 described above, the frame 24 may also include an encasing member 70 enclosing the outer layers of the bottom member 26, the first projection 28, the second projection 30, the core member 38, and the middle member 40. Hereinafter, for ease of description, the structure comprising the bottom member 26, the first projection 28, the second projection 30, the optional middle member 40 and the optional core member 38 is referred to as the encased structure.

In an exemplary embodiment, the encasing member 70 is made of a foamed material, such as PU, EVA, TPE, silicone, or the like. The hardness of the material of the encasing member 70 is less than the hardness of the material of the encased member. The encasing member 70 has a certain thickness and extensibility to enclose the encased structure comprising the bottom member 26, the first projection portion 28, the second projection portion 30, the core member 38 and the middle member 40 of the frame 24. Specifically, the encasing member 70 may completely enclose the encased structure. The outer boundary of the encasing member 70 may extend beyond the outer boundary of the encased structure by at least 1 mm, and the thickness at the outer boundary of the encasing member 70 where the encased structure is not present is smaller than the thickness at the location of the encasing member 70 where the encased structure is present (which may be referred to as the middle location compared to the outer boundary). Since the encasing member 70 increases the area of support for the breast and has a lower hardness of the material, it can provide better support for the breast while making the article of clothing more comfortable to wear.

In other embodiments of the present application, an encasing member 70 (not shown in the drawings) may also be provided on the outside of the frame 24 in FIGS. 5A, 5B, 5C, and 5D encasing the frame 24. Further, the outer boundary of the encasing member 70 may extend beyond the outer boundary of the encased frame 24 by at least 1 mm, and the thickness at the outer boundary of the encasing member 70 where the encased frame 24 is not present is smaller than the thickness at the location of the encasing member 70 where the encased frame 24 is present (which may be referred to as the middle location compared to the outer boundary). Additionally, the hardness of the material of the encasing member 70 is less than the hardness of the material of the encased frame 24.

Figure 5F:
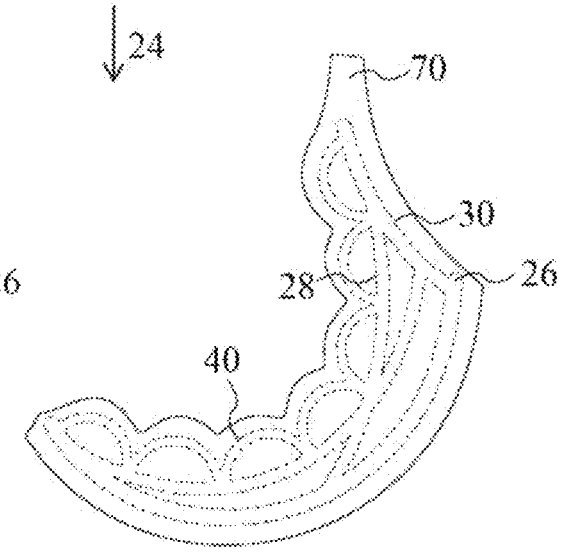
FIG. 5F shows a schematic diagram of the frame 24 according to one or more embodiments of the present disclosure.

FIG. 5F shows a schematic diagram of the frame 24 according to one or more embodiments of the present disclosure. Apart from the fact that the core member is not included, the structure and material characteristics of the frame 24 shown in FIG. 5F are the same as those of the frame 24 shown in FIG. 5E, and will not be repeated here. In addition, in other embodiments, the frame 24 in FIGS. 5A, 5B, 5C, and 5D may not include an inner core member. and may include an encasing member enclosing the frame 24 (not shown in the drawings).

Figure 7:
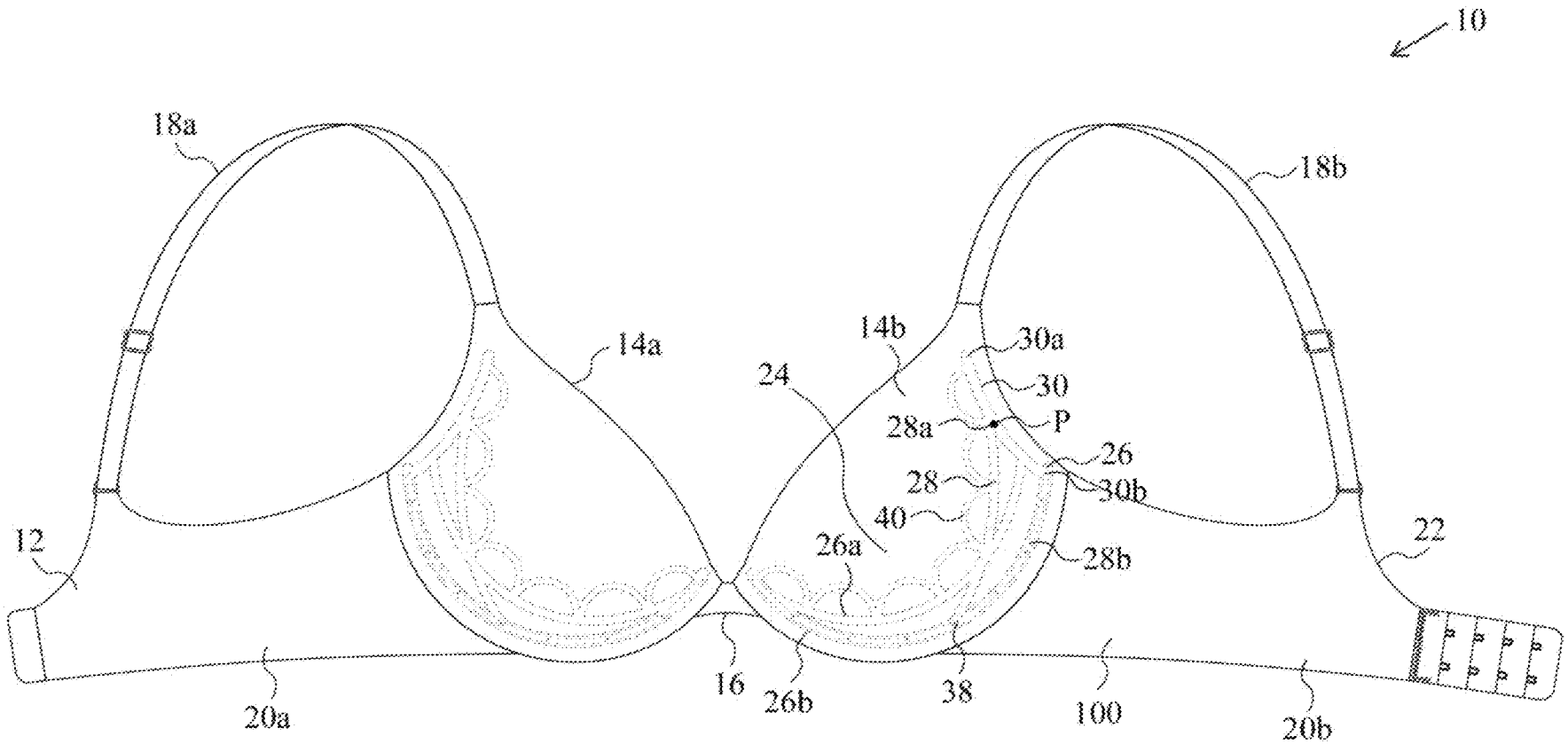
FIG. 7 shows a schematic diagram of a clothing 10 having a pair of frames 24 of FIG. 5D according to one or more embodiments of the present disclosure.

FIG. 7 shows a schematic diagram of an article of clothing 10 having a pair of frames 24 of FIG. 5D according to one or more embodiments of the present disclosure.

As shown in FIG. 7, the clothing 10 further includes a main body structure 12 that defines the shape of the clothing 10. In the exemplary clothing 10 of FIG. 7, the main body structure 12 may include a pair of brassiere cups having a first brassiere cup 14*a* and a second brassiere cup 14*b*. The center gore 16 may extend between the first brassiere cup 14*a* and the second brassiere cup 14*b* and connect the first brassiere cup 14*a* and the second brassiere cup 14*b*. A pair of shoulder straps including the first shoulder strap 18*a* and the second shoulder strap 18*b* may be attached to the peripheries of the first brassiere cup 14*a* and the second brassiere cup 14*b* respectively. In addition, a pair of side wings including the first side wing 20*a* and the second side wing 20*b* may be attached to the peripheries of the first brassiere cup 14*a* and the second brassiere cup 14*b* respectively. In one or more exemplary embodiments, one or more fastening portions 22 may be provided on one or more of the first side wing 20*a* and the second side wing 20*b*. It is appreciated that a pair of shoulder straps 18*a* and 18*b* support the clothing 10 as a bra on the shoulders of the wearer, and a pair of side wings 20*a* and 20*b* support the clothing 10 around the torso of the wearer. In some examples, the pair of shoulder straps 18*a* and 18*b* may not be provided, and only a pair of side wings 20*a* and 20*b* can support the clothing 10 on the wearer.

As shown in FIG. 7, the clothing 10 may include the frame 24 as shown in FIG. 5D in a pair of brassiere cups 14*a* and 14*b*. The clothing 10 including the frame 24 can provide better support for the breast. The frame 24 may include a bottom member 26, a first projection 28, a second projection 30, a core member 38, and a middle member 40. The structure, material and other properties of the frame 24 shown in FIG. 7 are similar to those of the frame 24 shown in FIG. 5D, and will not be repeated here.

Figure 8:
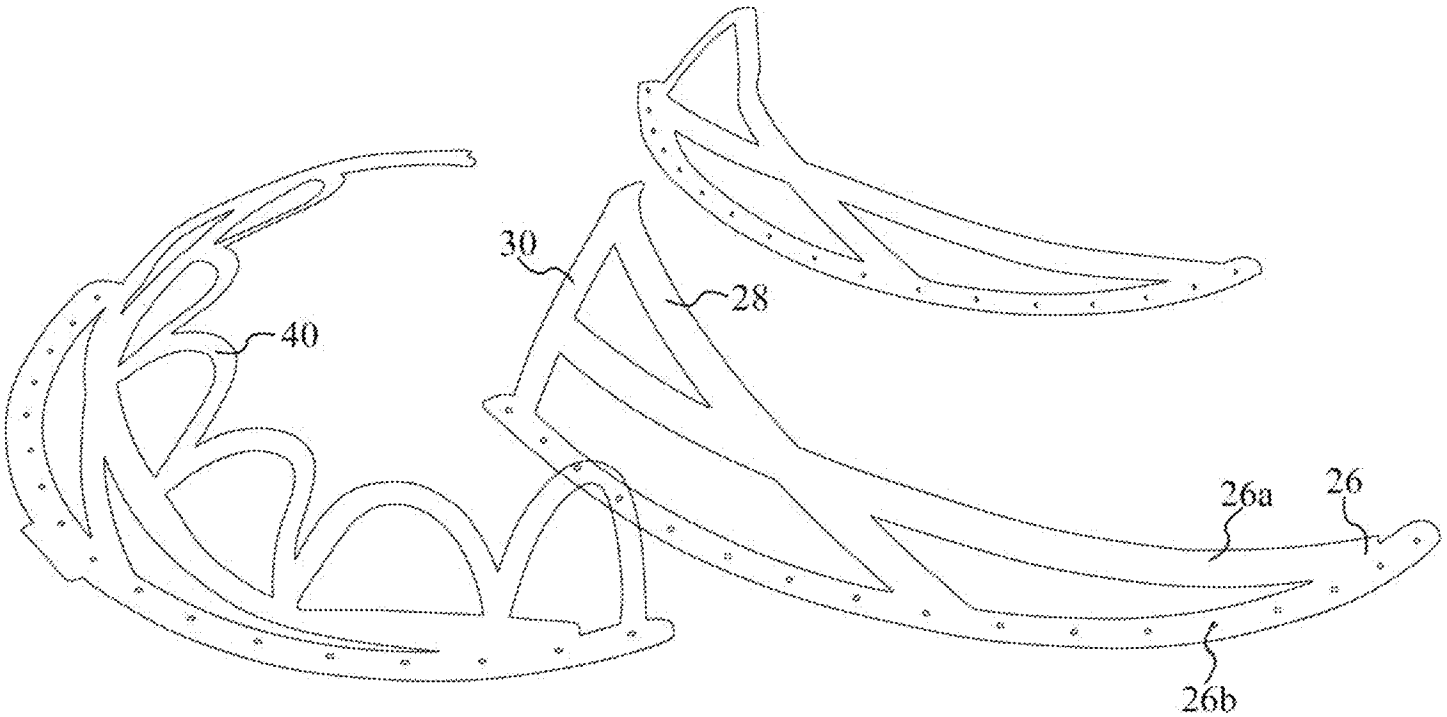
FIG. 8 shows a perspective view of the frame 24 according to one or more embodiments of the present disclosure.

FIG. 8 shows a perspective view of the frame 24 according to one or more embodiments of the present disclosure.

As shown in FIG. 8, the frame 24 may include a bottom member 26 located at a lower portion of a corresponding one of the brassiere cups. The bottom member 26 may include an upper member 26*a* and a lower member 26*b*. The lower member 26*b* of the bottom member 26 may be arc-shaped. The inner surface of the lower member 26*b* (the inner surface is the surface closer to the wearer's body) and the outer surface opposite the inner surface are generally flat, or "convex", so that the wearer can wear it comfortably.

The frame 24 may further include a first projection 28, a second projection 30, and a middle member 40. The first projection 28 may originate from the lower member 26*b* and extend beyond the upper member 26*a*. The second projection 30 may extend from the lower member 26*b* toward the apex of a corresponding one of the brassiere cups. The middle member 40 may be located above the upper member 26*a* at the position where a bra pad of the corresponding one of the pair of brassiere cups is located, so as to support the bra pad. The middle member 40 may also be located on the portion of the first projection 28 that extends beyond the upper member 26*a*, at the position where a bra pad of the corresponding one of the pair of brassiere cups is located so as to support the bra pad. The middle member 40 may be connected to the upper member 26*a* and/or the first projection 28 and/or the second projection 30. The bottom member 26, the first projection 28, the second projection 30, and the middle member 40 of the frame 24 may be integrally formed. The structure composed of the upper member 26*a*, the first projection 28, the second projection 30, and the middle member 40 of the frame 24 may have a 3D shape conforming to the shape of the brassiere cup, wherein the composed structure has a concave inner surface and a convex outer surface. Further, the first projection 28 and the second projection 30 form an obtuse angle on the outer side with the lower member 26*b*. In other words, the inner surface (closer to the wearer's body) of the lower member 26*b* of the frame 24 is flat or convex. The inner surface of the structure composed of the upper member 26*a*, the first projection 28, the second projection 30 and the middle member 40 of the frame 24 is concave. The concave inner surface of the structure formed by the upper member 26*a*, the first projection 28, the second projection 30, and the middle member 40 of the frame 24 substantially conforms to the shape of the wearer's breast. In addition, the outer surface of the first projection 28 and of the second projection 30 forms an angle between 90 degrees and 180 degrees with the outer surface of the lower member 26*b*.

Figure 9:
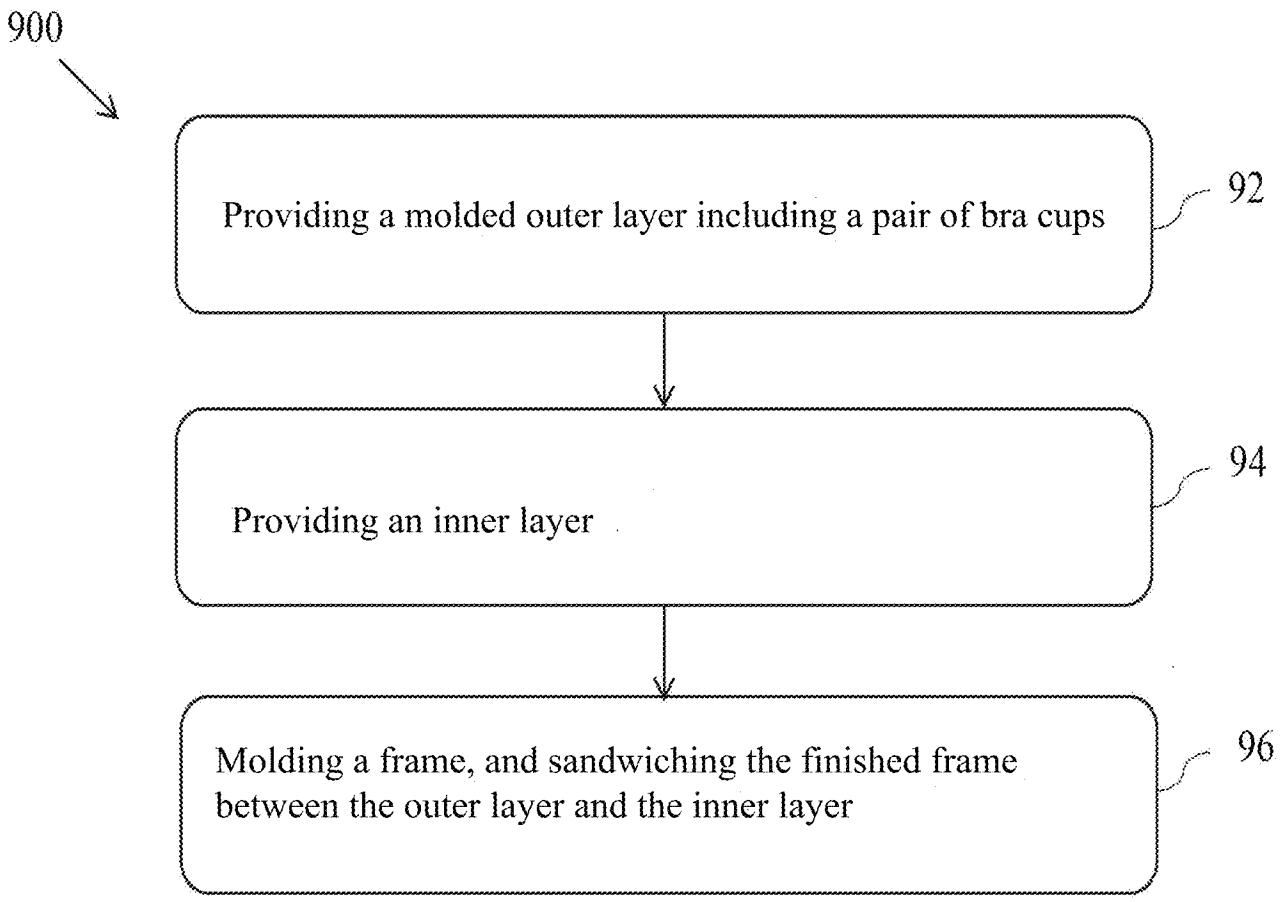
FIG. 9 illustrates a method of manufacturing clothing according to one or more embodiments of the present disclosure.

FIG. 9 illustrates a method 900 of manufacturing an article of clothing according to one or more embodiments of the present disclosure.

The method 900 includes, at step 92, providing a molded first layer, which is preferably an outer layer. The molded first layer may include a single brassiere cup or a pair of brassiere cups. The molded first layer may include a fabric layer and laminated foam material. At step 94, a second layer is provided, which is preferably an inner layer. In step 96, a frame is molded, and the finished frame is sandwiched between the first layer and the second layer. The molded frame may be, for example, the frame in any of the embodiments described with reference to FIGS. 5A to 5F.

Figure 10:
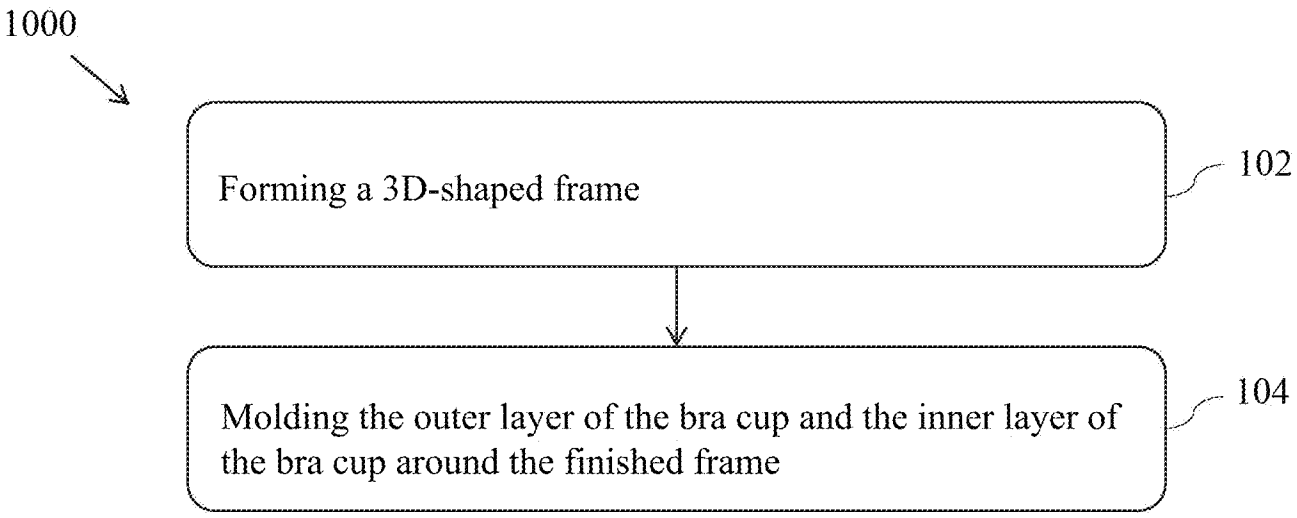
FIG. 10 illustrates a method of manufacturing clothing according to one or more embodiments of the present disclosure.

FIG. 10 illustrates a method 1000 of manufacturing an article of clothing according to one or more embodiments of the present disclosure.

The method 1000 includes, at step 102, forming a 3D-shaped frame, such as the frame 24 shown in FIG. 8. In step 104, the pre-formed 3D-shaped frame is placed in a mold, and the outer layer of the cup and the inner layer of the cup are formed around the frame by a molding method. After step 104 is completed, the frame is interposed between the outer layer of the cup and the inner layer of the cup. In other embodiments, in step 104, the outer layer of the cup and the inner layer of the cup may be pre-molded to form a 3D shape, wherein the shape of the outer layer of the cup and the inner layer of the cup may conform to the 3D shape of the frame. Then, the 3D-shaped outer layer of the cup and the inner layer of the cup are combined with the 3D-shaped frame made in step 102 to form an article of clothing with a frame between the outer layer of the cup and the inner layer of the cup.

Figure 11:
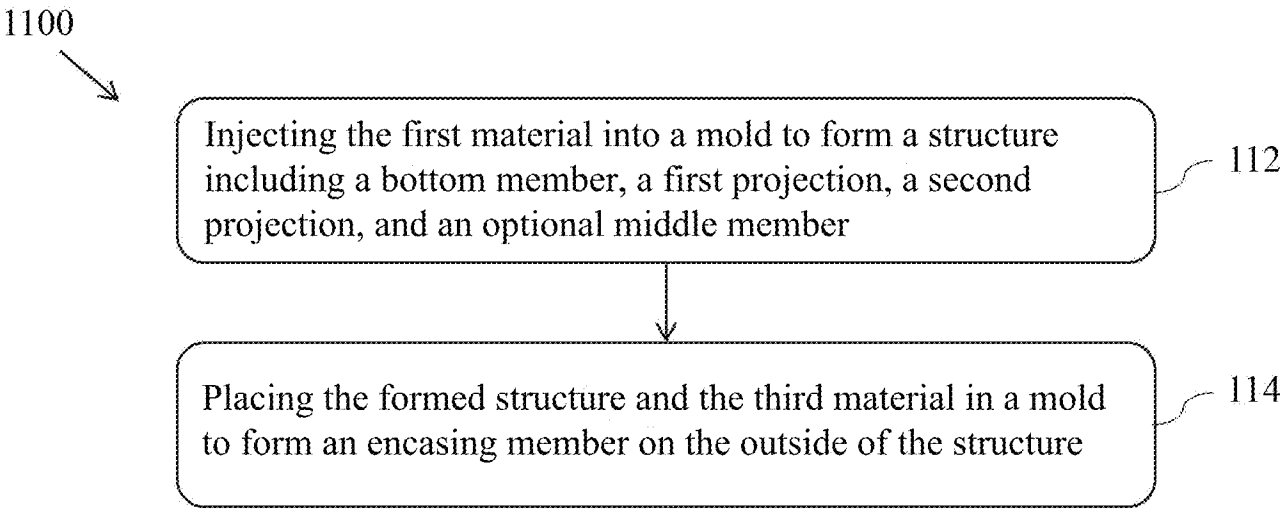
FIG. 11 shows a method of manufacturing a frame according to one or more embodiments of the present disclosure.

FIG. 11 shows a method 1100 of manufacturing a frame according to one or more embodiments of the present disclosure.

The method 1100 includes in step 112, injecting a first material into a mold to integrally form a structure including the following components: a bottom member located at a lower portion of a corresponding one of a pair of brassiere cups, wherein the bottom member includes an upper member and a lower member; at least one first projection, the at least one first projection originating from the lower member and extends beyond the upper member; and at least one second projection, the at least one second projection originating from the lower member and extending beyond the upper member. Here, the at least one second projection is closer to the underarm area of the corresponding one of the pair of brassier cups than the at least one first projection. Optionally, in other embodiments, injecting the first material into the mold in step 112 may also form a middle member, and the middle member may have a wave shape, such as the middle member 40 of the frame 24 as shown in FIG. 5D. The middle member may consist of a number of generally arc shapes arranged in close proximity to each other. The middle member may also be constructed of other shapes. The middle member may be located above the upper member, at a position where a bra pad of a corresponding one of the pair of brassiere cups is located so as to support the bra pad. The middle member may also be located on the portion of the first projection that extends beyond the upper member, at the position where a bra pad of the corresponding one of the pair of brassiere cups is located, so as to support the bra pad. The middle member may be connected to the upper member and/or the first projection and/or the second projection. The first material may, for example, be PP, PA, TPU, TPR, POM, TPE and other thermoplastic injection molding materials.

The method 1100 may further include, in step 114, placing the structure formed in step 112 that includes the bottom member, the first projection, the second projection and the optional middle member and the third material in the mold, so as to form an encasing member, such as the encasing member 70 of the frame 24 as shown in FIG. 5F, on the outside of the structure including the bottom member, the first projection, the second projection, and the optional middle member. In this embodiment, the encasing member comprises the third material, and the hardness of the third material is less than the hardness of the first material. The encasing member may completely enclose the bottom member, the first projection, the second projection, and/or the middle member. The encasing member can provide a larger area of support for the breast and better comfort. The third material may, for example, be a foam material such as PU, EVA, TPE, or silicone resin.

In this embodiment, the hardness of the first material is greater than the hardness of the third material.

Figure 12:
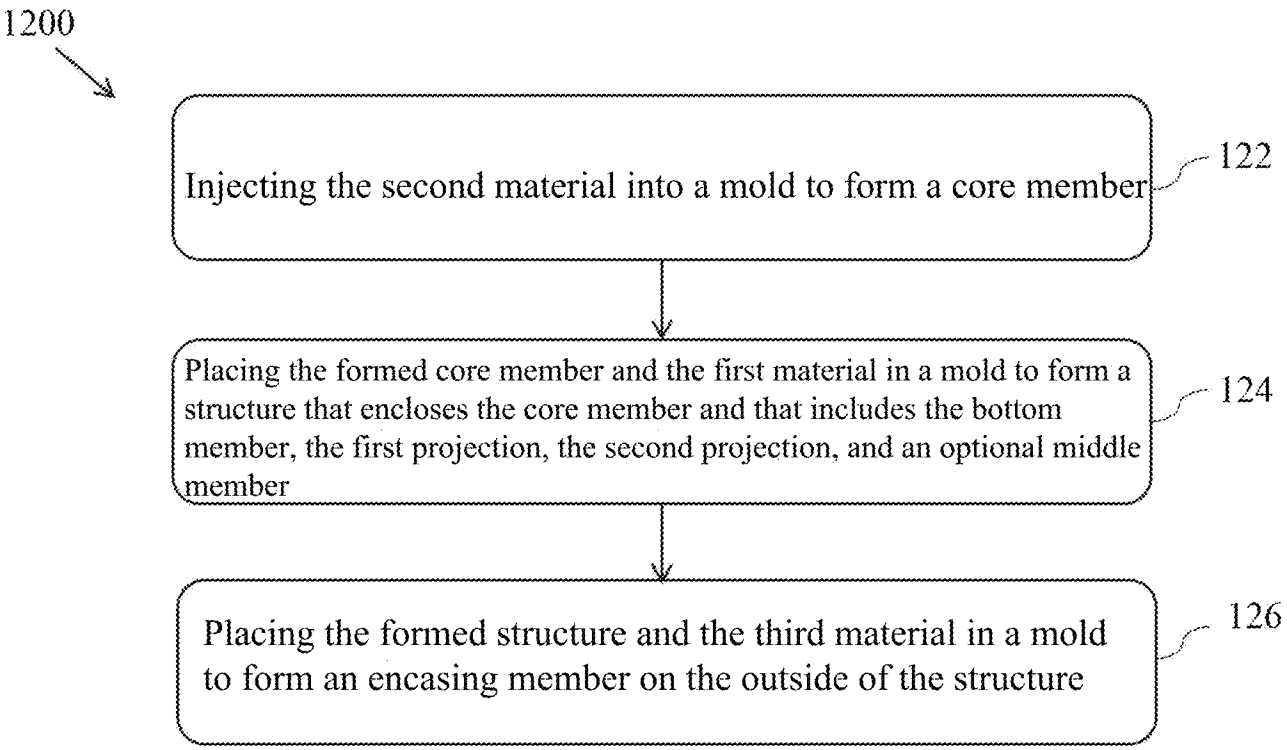
FIG. 12 illustrates a method of manufacturing a frame according to one or more embodiments of the present disclosure.

FIG. 12 illustrates a method 1200 of molding a frame according to one or more embodiments of the present disclosure.

The method 1200 includes, in step 122, injecting a second material into the mold to form a core member, such as the core member 38 shown in FIGS. 5A to 5E. The second material may, for example, be a thermoplastic material such as PP, PA, TPR, POM, TPE, etc.

In step 124, the core member formed in step 122 and the first material made are placed in a mold to mold and form an integrated structure as shown in FIGS. 5A to 5*d*, that encases the core member and that comprises the bottom member, the first projection, the second projection, and the optional middle member. The bottom member may include an upper member and a lower member. The core member is encased in the lower member of the bottom member. The length of the core member may be less than or equal to the length of the lower member. The first projection originates from the lower member and extends beyond the upper member. The second projection extends from the lower member toward and/or beyond the apex of a corresponding one of the brassiere cups. The first projection and the second projection may intersect at a point in their extension direction. The second projection is closer to the underarm area and/or the apex of the corresponding one of the brassiere cups than the first projection, and when the bra is worn, provides support and resistance to the forces applied respectively to the apex and the side of the brassiere cup to which a side wing is attached. The middle member may be wave-shaped. The middle member may be located above the upper member, at a position where a bra pad of the corresponding one of the pair of brassiere cups is located so as to support the bra pad. The middle member may also be located over the portion of the first projection that extends beyond the upper member, at the position where a bra pad of the corresponding one of the pair of brassiere cups is located so as to support the bra pad.

The middle member may be connected to the upper member and/or the first projection and/or the second projection. Optionally, in other embodiments, the middle member may not be formed. The first material may, for example, be PP, PA, TPU, TPR, POM, TPE and other thermoplastic injection molding materials.

In step 126, the structure formed in step 124 that includes the bottom member, the first projection, the second projection and the optional middle member and the third material are placed in the mold, so as to form an encasing member on the outside of the structure that includes the bottom member, the first projection, the second projection and the optional middle member, as shown in FIG. 5E. The encasing member may completely enclose the bottom member, the first projection, the second projection, and the middle member. The encasing member can provide a larger area of support for the breast and better comfort. The encasing member comprises the third material, and the third material may, for example, be a foam material such as PU, EVA, TPE, or silicone resin. In this embodiment, the first material and the second material may be the same material, the hardness of the second material is greater than the hardness of the first material, and the hardness of the first material is greater than the hardness of the third material.

The various clothing and methods described above provide a number of ways to carry out some preferred embodiments of the invention. Of course, it is to be understood that not necessarily all objectives or advantages described may be achieved in accordance with any particular embodiment described herein. Thus, for example, those skilled in the art will recognize that the compositions may be made and the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments. Similarly, the various components, features and steps discussed above, as well as other known equivalents for each such component, feature or step, can be mixed and matched by one of ordinary skill in this art to make compounds and perform methods in accordance with principles described herein.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. An article of clothing, comprising:

a pair of brassiere cups; and a pair of frames, each frame comprising:

a bottom member located at a lower portion of a respective one of the brassiere cups, wherein the bottom member comprises an upper member and a lower member;

at least one first projection, the at least one first projection originating from the lower member and extending beyond the upper member; and at least one second projection, the at least one second projection originating from the lower member and extending beyond the upper member;

wherein the at least one second projection is closer than the at least one first projection to an underarm region of the respective one of the brassiere cups and is longer in length than the at least one first projection, wherein the upper member has first and second ends and the lower member has first and second ends, and wherein the upper member and the lower member are connected at both of the first and second ends and enclose a hollow crescent shape.

2. The article of clothing according to claim 1, wherein the at least one first projection is connected to the upper member and has first and second ends, and wherein the first end of the at least one first projection is connected to the lower member and the second end of the at least one first projection lies beyond the upper member.

3. The article of clothing according to claim 1, wherein the at least one second projection is connected to the upper member and has first and second ends, and wherein the first end of the at least one second projection is connected to the lower member and the second end of the at least one second projection extends towards an apex of the respective one of the brassiere cups.

4. The article of clothing according to claim 1, wherein the at least one first projection comprises a first projection member having first and second ends and a second projection member having first and second ends, and wherein the first end of each of the first projection member and the second projection member is connected to the lower member and the second end of each of the first projection member and the second projection member extends beyond the upper member, the first projection member and the second projection member are spaced apart from each other, and the second ends of the first projection member and the second projection member are connected.

5. The article of clothing according to claim 1, wherein the at least one second projection comprises a first projection member having first and second ends and a second projection member having first and second ends, and wherein the first end of each of the first projection member and the second projection member is connected to the lower member and the second ends of the first projection member and the second projection member are connected to form a rounded corner.

6. The article of clothing according to claim 1, wherein the frame comprises one or more of Polypropylene (PP), Polyamide (PA), Thermoplastic Polyurethane (TPU), thermoplastic rubber (TPR), Polyoxymethylene (POM), and thermoplastic elastomers (TPE) material.

7. The article of clothing according to claim 1, wherein an inner surface of the lower member that is closer to a wearer's body and an outer surface opposite the inner surface are planar or convex.

8. The article of clothing according to claim 1, wherein each frame further comprises a middle member positioned above the upper member at a position where a bra pad of a corresponding one of the pair of brassiere cups is positioned, so as to support the bra pad.

9. The article of clothing according to claim 8, wherein the middle member is wave-shaped and includes a plurality of continuous arcs.

10. The article of clothing according to claim 8, wherein the structure consisting of the upper member, the first projection, the second projection and the middle member of the frame has a concave inner surface and a convex outer surface, and has a 3D shape that conforms to the shape of a corresponding one of the pair of brassiere cups.

11. The article of clothing according to claim 1, wherein an outer surface of the at least one first projection and the at least one second projection and an outer surface of the lower member form an angle between 90 degrees and 180 degrees.

12. The article of clothing according to claim 1, wherein the frame further comprises a core member arranged inside the lower member in a manner of being encased by the lower member.

13. The article of clothing according to claim 12, wherein the bottom member, the at least one first projection, the at least one second projection, and the middle member have a material hardness that is less than a material hardness of the core member.

14. The article of clothing according to claim 12, wherein a cross-section of the core member is L-shaped.

15. The article of clothing according to claim 12, wherein an upper arc width of the core member is greater than or equal to a lower arc width.

16. The article of clothing according to claim 1, wherein the frame further comprises an encasing member enclosing the bottom member, the at least one first projection, the at least one second projection, and the middle member.

17. The article of clothing according to claim 16, wherein the encasing member has a material hardness that is less than the material hardness of the bottom member, the at least one first projection, the at least one second projection, and the middle member.

18. The article of clothing according to claim 1, wherein, comparing with an end of the at least one first projection extending beyond the upper member, an end of the at least one second projection extending beyond the upper member extends to an apex of a respective one of the pair of brassiere cups.

19. The article of clothing according claim 1, wherein the upper and lower members are connected at one end and to the at least one second projection at the other end.

20. An article of clothing, comprising:

a pair of brassiere cups; and a pair of frames, each frame comprising:

a bottom member located at a lower portion of a respective one of the brassiere cups, wherein the bottom member comprises an upper member and a lower member;

at least one first projection, the at least one first projection originating from the lower member and extending beyond the upper member; and at least one second projection, the at least one second projection originating from the lower member and extending beyond the upper member;

wherein the at least one second projection is closer than the at least one first projection to an underarm region of the respective one of the brassiere cups and is longer in length than the at least one first projection, wherein the at least one first projection comprises a first projection member having first and second ends and a second projection member having first and second ends, and wherein the first end of each of the first projection member and the second projection member is connected to the lower member and the second end of each of the first projection member and the second projection member extends beyond the upper member, the first projection member and the second projection member are spaced apart from each other, and the second ends of the first projection member and the second projection member are connected.

21. An article of clothing, comprising:

a pair of brassiere cups; and a pair of frames, each frame comprising:

a bottom member located at a lower portion of a respective one of the brassiere cups, wherein the bottom member comprises an upper member and a lower member;

at least one first projection, the at least one first projection originating from the lower member and extending beyond the upper member; and at least one second projection, the at least one second projection originating from the lower member and extending beyond the upper member;

wherein the at least one second projection is closer than the at least one first projection to an underarm region of the respective one of the brassiere cups and is longer in length than the at least one first projection, wherein the at least one second projection comprises a first projection member having first and second ends and a second projection member having first and second ends, and wherein the first end of each of the first projection member and the second projection member is connected to the lower member and the second ends of the first projection member and the second projection member are connected to form a rounded corner.

* * * * *